US012650058B2

(12) United States Patent
Møgedal et al.

(10) Patent No.: US 12,650,058 B2
(45) Date of Patent: Jun. 9, 2026

(54) SUBSEA ACTUATOR AND ASSOCIATED METHODS

(71) Applicant: OneSubsea AS, Oslo (NO)

(72) Inventors: Øystein Møgedal, Borgen (GB); Dmitri Volkov, Lier (NO); Henrik Dishington Haldorsen, Heggedal (NO); Geir Tandberg, Tranby (NO); Kent Havstein, Husøysund (NO); Bård Meling Eriksen, Stavanger (NO); Harald Nyhus, Oslo (NO); Emil Haugen, Drammen (NO)

(73) Assignee: OneSubsea AS, Oslo (NO)

( * ) Notice: Subject to any disclaimer, the term of this patent is extended or adjusted under 35 U.S.C. 154(b) by 0 days.

(21) Appl. No.: 18/939,236

(22) Filed: Nov. 6, 2024

(65) Prior Publication Data

US 2025/0146385 A1 May 8, 2025

(30) Foreign Application Priority Data

Nov. 6, 2023 (GB) ..... 2316998

(51) Int. Cl.
*E21B 41/00* (2006.01)
*E21B 34/04* (2006.01)

(52) U.S. Cl.
CPC ..... *E21B 41/0007* (2013.01); *E21B 34/04* (2013.01)

(58) Field of Classification Search
CPC ..... E21B 41/0007; E21B 34/04
USPC ..... 166/335
See application file for complete search history.

(56) References Cited

U.S. PATENT DOCUMENTS 4,213,480 A * 7/1980 Orum ..... F16K 31/143 251/14
4,650,151 A * 3/1987 McIntyre ..... E21B 34/04 251/63.5
6,091,670 A * 7/2000 Oliver ..... G01V 1/22 367/20
6,487,960 B1 * 12/2002 Chatufale ..... F15B 13/10 92/165 R
8,875,795 B2 * 11/2014 Choudhury ..... E21B 33/064 166/368

(Continued)

FOREIGN PATENT DOCUMENTS

CN 214221139 U 9/2021
WO 2022002981 A1 1/2022
WO 2022120123 A1 6/2022

*Primary Examiner* — Tara Schimpf
*Assistant Examiner* — Patrick F Lambe
(74) *Attorney, Agent, or Firm* — Kyle R. Miiller

(57) ABSTRACT

This invention relates to a subsea actuator with visual position indicators and associated methods for subsea energy infrastructure, such as in the oil and gas industry. The actuator may include a housing with a window, an actuation member, and a drive mechanism that moves the actuation member between at least two positions. The invention also relates to a method that involves providing a housing with a window, connecting the actuation member to a drive mechanism, and indicating the position of the actuation member through the window. This visual inspection can be performed directly or via a camera, even in the event of a power failure, using a passive, unpowered indicator. The indication can be displayed on an ROV panel, ensuring reliable remote monitoring and operation of the subsea actuator.

20 Claims, 17 Drawing Sheets

(56) References Cited

U.S. PATENT DOCUMENTS

| | | | | |
|---|---|---|---|---|
| 8,887,655 | B2 * | 11/2014 | Carlson | F16K 37/0008 137/553 |
| 2003/0111271 | A1 | 6/2003 | Dallas | |
| 2017/0191338 | A1 | 7/2017 | Whitby | |
| 2019/0330954 | A1 * | 10/2019 | Johnston | E21B 19/006 |

* cited by examiner

SUBSEA ACTUATOR AND ASSOCIATED METHODS

CROSS-REFERENCE TO RELATED APPLICATION

This application claims priority to and benefit of GB Patent Application No. 2316998.0, filed on Nov. 6, 2023.

This invention relates to actuators and their operation, particularly, but not exclusively, subsea actuators with status or position indicators; and associated methods.

BACKGROUND

In subsea applications, various types of infrastructure are deployed, often positioned along a sea floor. Traditionally, most of the subsea production systems have used hydraulic fluids for operating the subsea valves associated with such infrastructures, such as on subsea Xmas Trees ("XMTs"). In the oil/gas industry, subsea wellheads are typically at least partly controlled using Subsea Control Modules ("SCMs"), such as where an SCM controls a XMT associated with a production wellhead. The SCM provides well control functions, particularly during the production phase of subsea oil/gas production. The SCM contains electronics for performing a variety of functions, often including: processing communications signals, conditioning electrical power supplies, providing status information; and distributing signals and power to/from control valves, pressure/temperature sensors, and the like.

XMTs typically have various fluid barriers for controlling fluid, pressure, flow in the well. Periodically XMTs may require maintenance, inspection, etc. Often temporary barriers are placed using bores below the XMT. These bores are typically dedicated for such temporary use and access via these bores is only enabled when particular valves are open to allow such access. The valves are typically gate valves operable between a closed position, where the bore (below the XMT) is closed.

Such valves, to control or vary supply or flow of a fluid, are often controlled by actuators. For example, the gate valves are typically translated linearly between open and closed states using an actuator to push/pull the valve open and closed. The valves can be for controlling fluids, such as production, flow, shut-down, etc. The valves/actuators often have a failsafe mode, such as with a spring to automatically move the valve (e.g. in emergency or fault situations). Sometimes, such as where a primary drive mechanism fails, or a control or supply system therefor, it can be necessary to override the valve or the actuator. For example, a diver or ROV can typically access a mechanical override, for moving the actuator/valve.

Subsea actuators are often used in subsea equipment, such as in oil and gas equipment as a part of the subsea wellhead; or used in a subsea energy installation such as for a wind turbine or tidal generator. Subsea actuators are typically used for control, such as production control, supply, distribution, safety or other functions. The actuators are typically provided in a housing to protect them from the environmental conditions, in particular sea water ingress (may be at high pressure due to depth and/or subsea conditions) and contaminants.

It may be an object of one or more aspects, examples, embodiments, or claims of the present disclosure to at least mitigate or ameliorate one or more problems associated with the prior art, such as those described herein or elsewhere.

BRIEF SUMMARY OF THE DISCLOSURE

According to an aspect, there is provided an actuator. The actuator may comprise a subsea actuator. The actuator may be for subsea use, such as installed, particularly permanently, in or on a subsea structure. The subsea structure may comprise a portion of energy infrastructure, such as associated with the oil/gas industry. The actuator may be for actuation of an associated device or component. The associated device or component may comprise a valve, such as a gate valve. According to an aspect, there is provided a method of use of the actuator. The method may comprise indicating the position of the subsea actuator member.

Accordingly, in at least some examples, there is provided subsea actuator comprising:

a. a housing;

b. an actuation member;

c. a drive connected to the actuator member, wherein the drive is configured to move the actuation member between at least two positions; and a position indicator for providing an indication of a position of the actuator member, wherein the housing has a window for the position indicator.

The position indicator may comprise a visual indicator. The position indicator may comprise a viewable indicator. The position indicator may be viewable to a user, such as an operator, diver, inspector, or the like. Additionally, or alternatively, the position indicator may be viewable via a camera. For example, the position indicator may be viewable by a camera, such as a remotely-installed camera and/or a ROV camera. The position indicator may be located or locatable to be viewable from an exterior of the actuator, such as remotely from the actuator. In at least some examples, the position indicator is a visual indicator, viewable by a diver and/or a camera, and the position indicator is located in a sidewall of the housing so as to provide a lateral view of at least one of the two positions between which the actuator member is movable. The actuation member may be viewable through the window when the actuation member is in both of the two positions; and optionally all intermediate positions therebetween.

Accordingly, the method may comprise visually inspecting the actuator to monitor or check the position of the actuation member.

The method may comprise inspecting or monitoring a status of the actuator by visually inspecting or monitoring the position of the actuator. The position of the actuator member may correspond to a status of the actuator. For example, the actuator member may be movable between at least two positions. The at least two positions may comprise a first position, corresponding to an open position; and a second position, corresponding to a closed position (or vice versa).

The position of the actuator member may be visible via the window. The position of the actuator member may be visible through the window.

The position indicator may comprise a passive indicator. The position indicator may comprise an unpowered indicator. In contrast to powered indicators, such as electrical sensors, the position indicator may be a passive, unpowered indicator that does not require any additional input or energy compared to normal operation of an otherwise similar actuator but without such an indicator.

The position indicator may be provided without a dynamic seal/s. The actuator with the position indicator may comprise a same number of dynamic seals as the (same) actuator without the position indicator. A dynamic seal may be a seal that is associated with a moving part, such as a moving shaft or stem. For example, the actuator may comprise a dynamic seal associated with the stem or a link member for transferring movement from the actuation member to an associated device, such as an external valve or the like.

In at least some examples, there is provided a subsea actuator comprising:

a. a housing;
b. an actuation member in the housing;
c. a drive connected to the actuator member, wherein the drive is configured to move the actuation member between at least two positions; and a
d. position indicator for providing an indication of a position of the actuator member, the position indicator being provided without a dynamic seal.

Additionally, or alternatively, the provision of the window can enable various functions, in addition or as an alternative to indicating position of the actuation member.

Accordingly, in at least some examples, there is provided a subsea actuator comprising:

a. a housing;
b. an actuation member;
c. a drive connected to the actuator member, wherein the drive is configured to move the actuation member between at least two positions;
d. wherein the housing comprises a window in the housing, the window providing, in use, viewability into an interior of the housing.

The position indicator may comprise a static seal. For example, the window may comprise a window element attached to the housing. The window element may be attached to the housing with a static seal. For example, the window element may be mechanically attached to the housing with a static seal between the window element and the housing. The mechanical attachment may comprise one or more of: screwing; bolting; fastening; adhesion; clamping; bonding.

The indicator may comprise a marker movable with the movable actuation member. The movable marker may be associated with the actuation member, such as on or directly on the actuation member.

The window may comprise an opening. The window may comprise an opening in a wall of the housing. The wall may comprise a side wall. The housing may comprise a prismatic form. For example, the housing may comprise a cylindrical shape. The actuation member may be housed within the housing for movement of the actuation member internally within the housing.

The window may comprise a see-through window. The window may comprise a window element. The window may be at least translucent. The window may comprise a transparent window. The window may comprise a transparent material.

The window may correspond to at least a portion of a stroke of the actuation member.

The window may extend longitudinally. The window may extend longitudinally along the side wall of the housing. The window may extend axially. The window may extend along the at least a same length as a maximum stroke of the actuation member. Alternatively, the window may correspond to only a portion of the stroke. In such examples, the movable marker may comprise a scale, gauge or other indicia; such that the movable marker spans at least a portion of the stroke of the actuation member. Accordingly, a relative position of the actuation member may be indicated by the part of the scale, gauge or other indicia that corresponds to (e.g. is adjacent) the window for that position of the actuation member in its stroke.

Additionally, or alternatively, the window may extend circumferentially. The window may extend circumferentially around a substantive portion of the housing. The window may extend circumferentially around an entirety of the housing. In at least some examples, there is provided an actuator with an entirely transparent housing.

The window may comprise a longitudinal window. The window may comprise a slot. The window may run longitudinally along the housing, in a same direction as a direction of movement of the actuation member within the housing.

The window may comprise or at least be associated with a guide channel. For example, the actuator may comprise a guide channel for guiding the movement of the actuation member therein. The guide channel may comprise an anti-rotation guide channel. The actuation member may comprise or be connected to a guide member. The guide member may comprise an anti-rotation member. The anti-rotation member may be configured to prevent or at least mitigate rotation of the actuation member. The anti-rotation member may be for assisting in converting forces or movements between rotational and linear. For example, the anti-rotation member may be for converting a torque applied to the actuator to a linear movement of the actuator member. The anti-rotation member may be axially movable within the guide channel to guide the axial movement of the actuation member. The anti-rotation member may provide an indication through the window of the axial position of the actuation member.

The movable marker may be, or may be associated with, the guide member. The guide member may be connected or coupled to the actuation member.

The actuator may comprise at least one fixed indicia, scale or gauge; said indicia, scale or gauge having a fixed marking corresponding to at least one of the positions between which the actuation member is movable. The fixed indicia, scale or gauge may be provided at the display, such as on or adjacent the window; and/or the ROV panel.

The window may comprise an opening in a sidewall of the housing. A longitudinal indicator member may be connected to the opening. The longitudinal member may extend from the opening at a proximal end of the longitudinal member to a display end at a distal end of the longitudinal member. The longitudinal member may be an optical member, for transmission of light between the opening and the display end. For example, the longitudinal member may comprise a light guide, fibre-optic, glass member, or the like. Alternatively, the longitudinal member may be a mechanical member, for transmission of movement between the opening and the display end. For example, the mechanical member may comprise a movable rod, wire, cable, tube, or the like. The mechanical member may comprise a flexible member. The mechanical member may comprise a bendable member. The mechanical member may comprise a fixed length, in use.

The position indicator may be configured to display the indication of the position of the actuator member on a ROV panel. In at least some examples, the position indicator extends to, or is connected to, the ROV panel. For example, where the position indicator comprises a longitudinal member connected to the opening, the longitudinal member may extend to the ROV panel.

The window in the housing may provide a visual indication of status. In at least some examples, the window can provide an indication of a presence of a fault within the housing. The window may provide an indication of a presence of a possible future fault. For example, the window may provide an indication of a presence of ingress of a contaminant or other undesirable material, such as water, in the housing. Accordingly, the window may provide indication, such as early indication, of a potential failure or fault. In at least some examples, the window may provide an indication of an undesirable penetration of water into the housing, such as associated with a failed seal or other pressure integrity issue. The window may provide a visual indication of a plurality of statuses. For example, the window can provide an indication of the position of the actuator member and also of a presence of a contaminant or other undesirable material. The presence of a contaminant or other undesirable material can be a precursor to a possible future failure of the actuator. For example, where water has penetrated into the actuator, then the movement of the actuator member may become inhibited (e.g. due to displacement of (lubricating) oil, development of rust, marine growth, etc.). Accordingly, (early) detection of the presence of water via the window can help pre-empt an actual failure developing. In at least some examples, the window is configured to provide an indication of a housing integrity failure, such as a presence of water ingress into a housing interior.

The actuator may comprise an oil-filled, pressure compensated actuator. The actuator may comprise an electric actuator. Accordingly, in at least some examples, the subsea actuator comprises an electrically-driven actuator and the housing comprises a pressurised container, the housing being filled with an oil-filled compensated volume.

All of the components of the indicator may be located within a fluid system of the actuator. For example, all of the moving parts of the indicator may be located within the oil-filled, pressurised volume associated with the interior of the housing.

In at least some examples, the subsea actuator is used in subsea oil and gas equipment, such as a part of a subsea well. In other examples, the subsea actuator is used in a subsea energy installation such as for a wind turbine, tidal generator, subsea chemical process, hydrogen or CO2 processing, or the like.

Accordingly, there may be provided a subsea system comprising at least one subsea actuator according to any aspect, example, embodiment, claim; and a subsea structure. The subsea structure may comprise at least one of: an oil/gas structure; a Xmas tree; a manifold; a subsea control module; a valve/s.

According to an aspect, there is provided a method of indicating a position of a subsea actuator member. The method may comprise providing a housing of the subsea actuator with a window. The method may comprise connecting an actuation member within the housing to a drive. The method may comprise connecting the actuation member within the housing to the drive such that the actuation member is movable between at least two positions. The method may comprise providing an indication of a position of the actuator member. The method may comprise providing the indication of the position of the actuator member via the window in the housing.

Accordingly, in at least some examples, there is provided a method of indicating a position of a subsea actuator member, the method comprising:

i. providing a housing of the subsea actuator with a window;

ii. connecting an actuation member within the housing to a drive, such that the actuation member is movable between at least two positions; and a iii. providing an indication of a position of the actuator member via the window in the housing.

The method may comprise a user viewing the position of the actuator member directly through the window or via a camera. The method may comprise viewing the actuation member through the window when the actuation member is in both of the two positions and all intermediate positions therebetween. The method may comprise indicating the position of the actuator member in an event of a power failure to the actuator. The method may comprise providing the position indicator as a passive, unpowered indicator, such that the method comprises indicating the position of the actuator member in an event of a power failure to the actuator.

The method may comprise displaying the indication of the position of the actuator member on a ROV panel. The method may comprise providing an indication of a housing integrity failure, such as a presence of water ingress into a housing interior.

According to an aspect, there is provided a method of using the system, such as comprising the subsea actuator, according to an aspect, claim, embodiment or example of this disclosure.

The steps of the method may be in any order.

According to an aspect, there is provided an apparatus configured to perform a method according to an aspect, claim, embodiment or example of this disclosure.

Within the scope of this disclosure it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. The applicant reserves the right to change any originally filed claim or file any new claim accordingly, including the right to amend any originally filed claim to depend from and/or incorporate any feature of any other claim although not originally claimed in that manner.

BRIEF DESCRIPTION OF THE DRAWINGS

Embodiments of the invention are further described hereinafter with reference to the accompanying drawings, in which.

a.

b.

c.

d.

e.

f.

g.

h.

i.

j.

k.

l.

m.

n.

o.

p.

q.

r.

DETAILED DESCRIPTION

Figure 1:
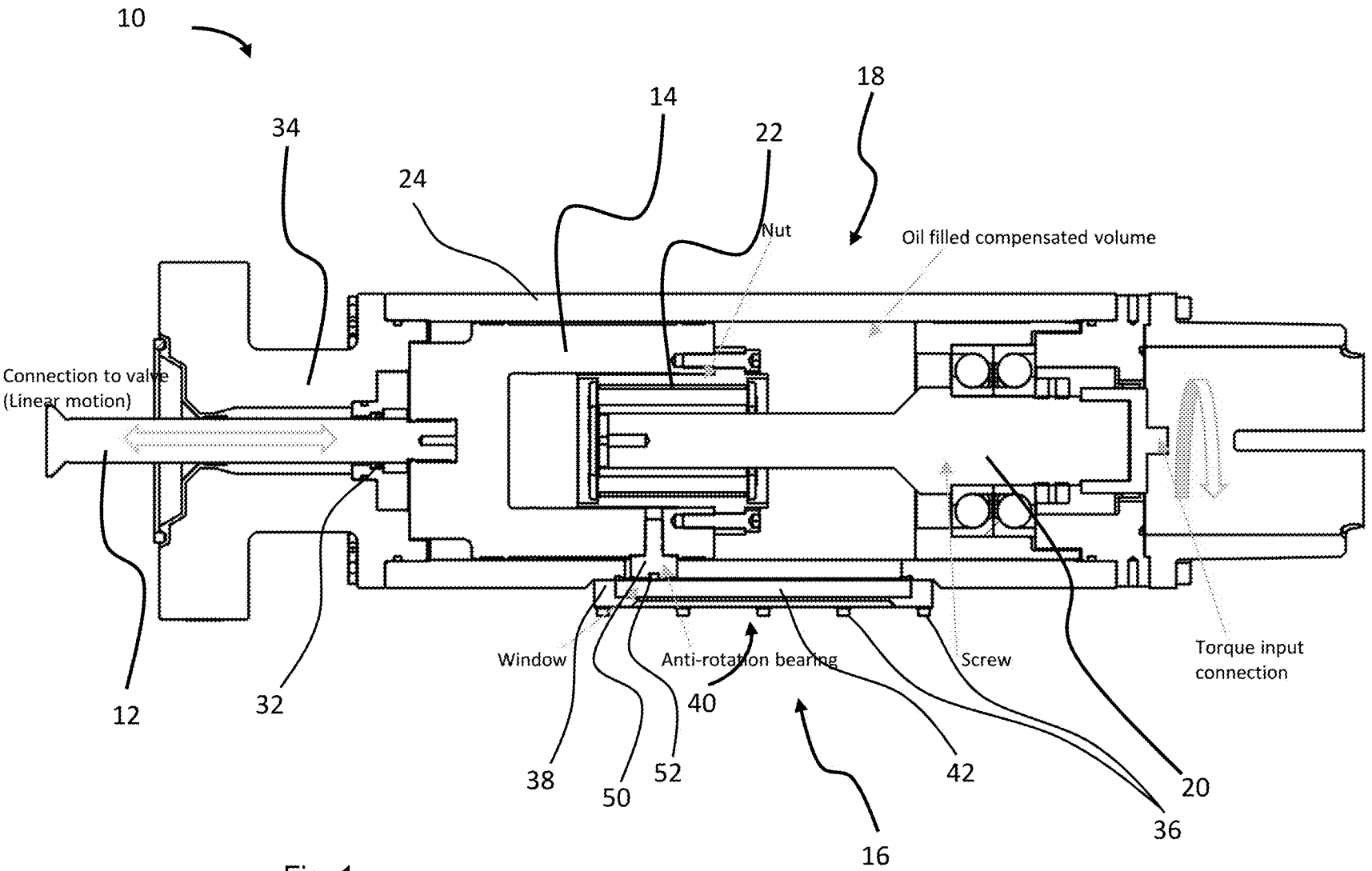
FIG. 1 shows a schematic cross-sectional view of an actuator according to the present disclosure.
Figure 1B:
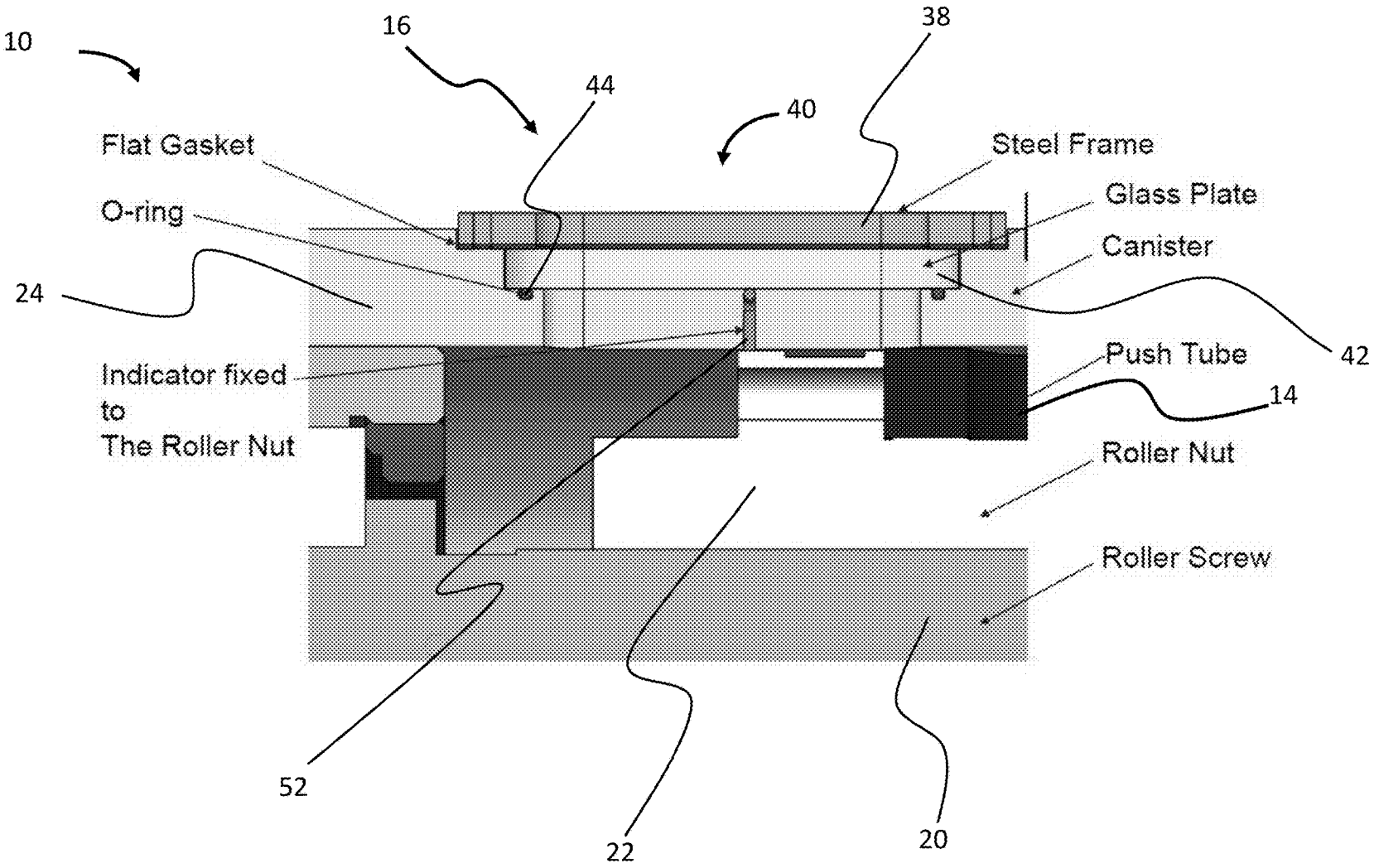
FIG. 1*b* shows a further schematic cross-sectional view of the actuator of FIG. 1.

Referring firstly to FIG. 1, there is shown a subsea actuator 10 according to a first example. Here, the subsea actuator 10 comprises an actuator 10, for subsea use, such as installed, particularly permanently, in or on a subsea structure. Here, the subsea structure comprises a portion of energy infrastructure, such as associated with the oil/gas industry. The actuator 10 is for actuation of an associated device or component, shown in examples here as a valve, particularly a gate valve. Accordingly, there is provided subsea actuator 10 comprising a housing 24; an actuation member 14; a drive connected to the actuator member 14, wherein the drive is configured to move the actuation member 14 between at least two positions; and a position indicator 16 for providing an indication of a position of the actuator member 14, wherein the housing has a window 40 for the position indicator 16.

Here, the actuator 10 comprises an electrically-operable subsea actuator 10 for providing a subsea electrical actuation of the valve (not fully visible in FIG. 1). The actuator 10 comprises a screw assembly 18, here in the form of a roller screw assembly. The screw assembly 18 comprises a screw 20 and a threaded part 22. Here, the roller screw assembly 18 comprises a roller screw 20 and a roller nut 22, with the roller nut 22 being associated with the movable actuator member 14 here. The actuator 10 comprises a housing 24 for the roller screw assembly 18; and an axial stop for preventing axial movement relative to the housing 24 of one of the roller screw 20 and the roller nut 22. The actuator 10 comprises a primary drive for providing a rotational movement to the roller screw assembly 18 in a normal mode of operation. The roller screw assembly 18 converts the rotational movement to an axial movement of a valve member relative to the housing 24.

The roller screw 20 of the roller screw assembly 18 here comprises a longitudinal member in the form of a rigid, solid threaded rod. The roller nut 22 assembly comprises a plurality of rollers for transmitting drive between the screw 20 and the roller nut 22 of the roller screw assembly 18. The transmission converts a rotational motion of the roller screw 20 to a longitudinal motion of the roller nut 22. In other examples (not shown) the roles of the roller nut 22 and the roller screw 20 may be reversed, with the transmission converting a rotational motion of the roller nut 22 to a longitudinal motion of the roller screw 20.

The roller screw assembly 18 is operable by converting rotational movement or torque, such as from a motor (e.g. electric), to axial movement or force. The axial movement or force is relative between a portion of the roller screw assembly 18 and the transmission. Accordingly, operation of the roller screw 20 provides an axial movement of the roller nut 22 relative to the roller screw 20. The axial movement here comprises linear movement (e.g. of the roller nut 22 from right to left, or left to right, as shown in FIG. 1). Here, the roller screw assembly 18 defines a linear actuator. The actuator 10 comprises a motor, which is the primary drive for operating the actuator 10 in the normal mode of operation, as shown in FIG. 1. The valve here has a valve rod or stem 12. The valve stem 12 extends through a stem seal 32 housed in a bonnet 34. The stem seal 32 is a dynamic seal, allowing movement of the valve stem 12 in/out of the oil-filled pressure compensated interior of the housing 24 of the actuator 10.

The roller screw assembly 18 is operable to selectively axially drive the actuator 10 cyclically between open and closed positions. For example, the roller screw assembly 18 is operable to push the actuator member 14, connected to the valve stem 12, to an open position (as shown in FIG. 1) and to pull the valve stem 12 to a closed position (with the actuator member 14 moved to the right of the position shown in FIG. 1, similar to the position shown in FIG. 7). The operation of the actuator 10, with its roller screw assembly 18, here is generally similar to that of Applicant's earlier patent application PCT/EP2021/067922, published as WO2022002981A1, the contents of which are incorporated herein by reference.

The position indicator 16 comprises a visual indicator, viewable to a user, such as an operator, diver, inspector, or the like. It will be appreciated that the position indicator 16 is directly viewable; and also viewable via a camera, such as a remotely-installed camera or a ROV camera. The position indicator 16 is located to be viewable from an exterior of the actuator 10, located in a sidewall of the housing 24 so as to provide a lateral view of at least one of the two positions between which the actuator member 14 is movable.

Figure 3:
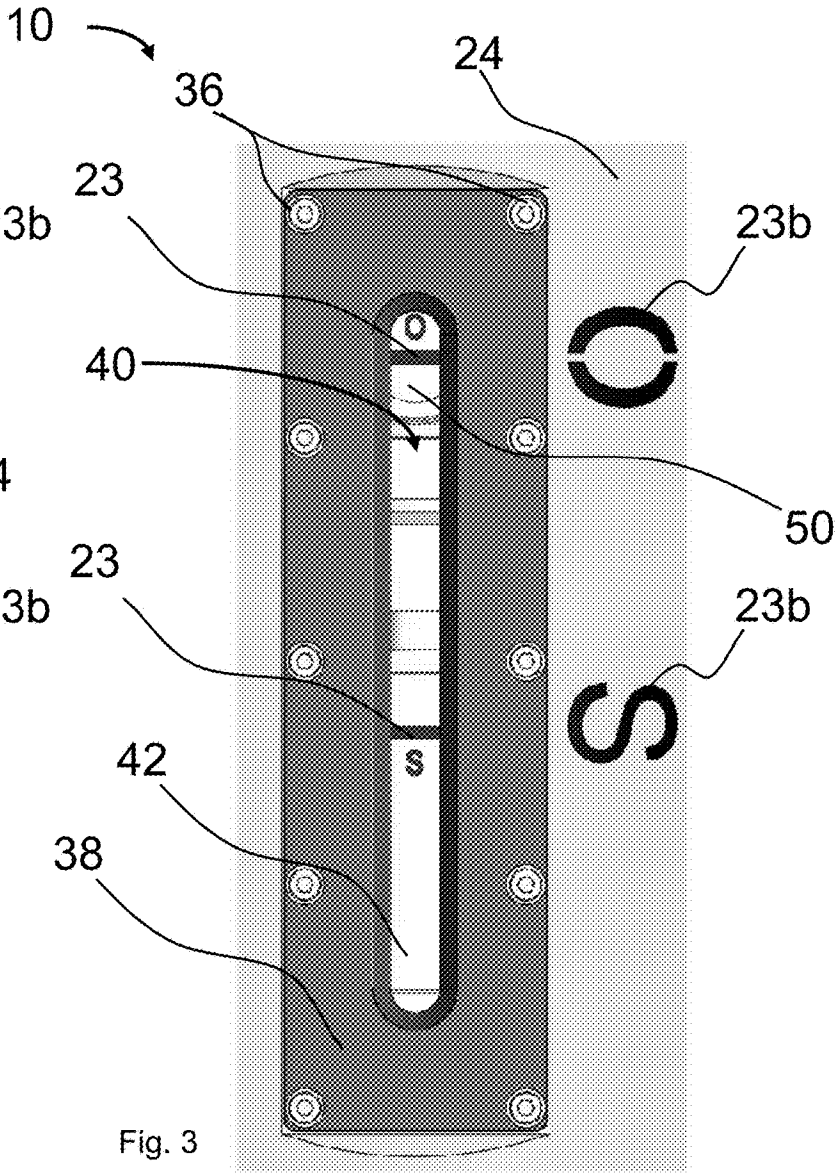
FIG. 3 shows a partial view of the window of the actuator of FIG. 1, with the actuator in a second configuration.
Figure 2:
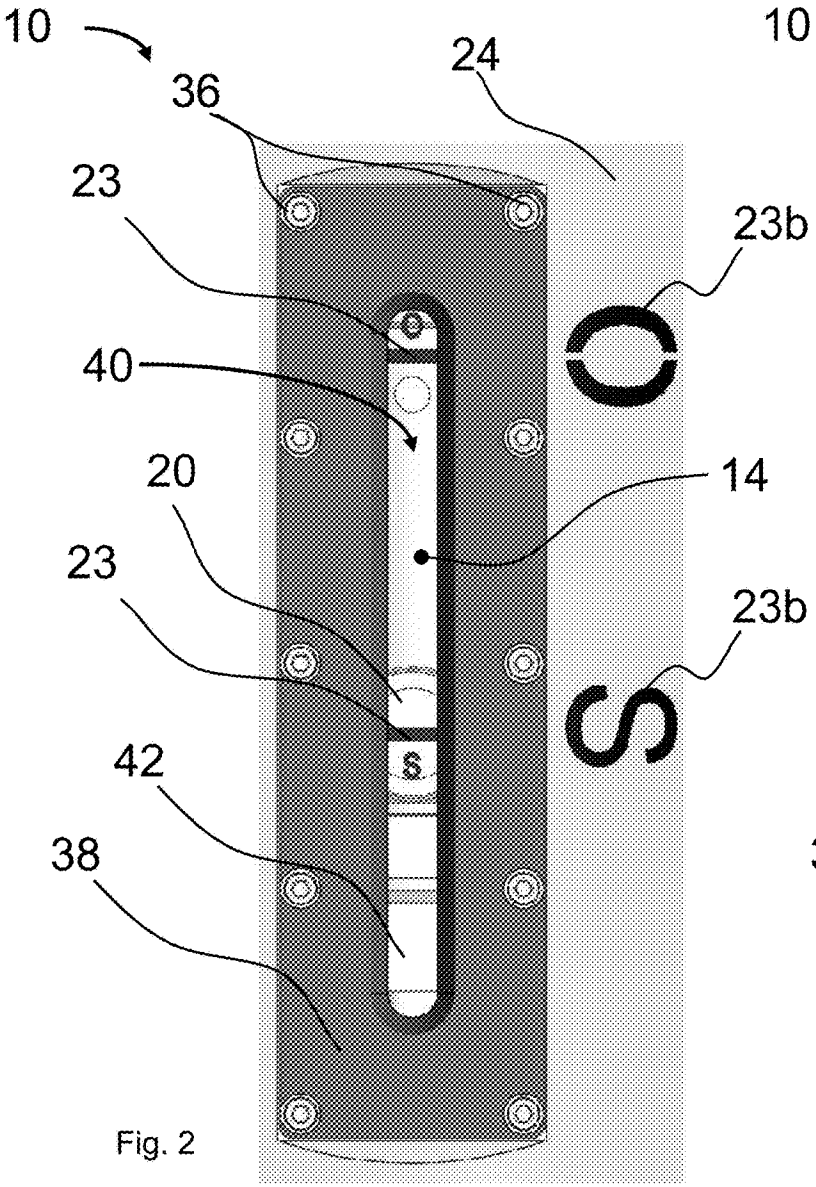
FIG. 2 shows a partial view of a window of the actuator of FIG. 1, with the actuator in a first configuration.

Referring now to FIG. 2, there is shown a partial view of the window 40 of the actuator 10 of FIG. 1, with the actuator 10 in a first configuration. Here, the first configuration corresponds to a Shut or closed configuration of the actuator 10, such as where the actuator member 14 has pulled the valve stem 12 to close the valve, caused by rotation of the roller screw 20. FIG. 3 shows a partial view of the actuator 10 of FIG. 1, with the actuator 10 in a second configuration. Here, the second configuration corresponds to an Open configuration of the actuator 10, such as where the actuator member 14 has pushed the valve stem 12 to close the valve, caused by rotation of the roller screw 20 (such as shown in FIG. 1).

As can be seen in FIGS. 2 and 3, the actuation member 14 is viewable through the window 40 when the actuation member 14 is in both of the two positions; and optionally all intermediate positions therebetween.

Figure 4:
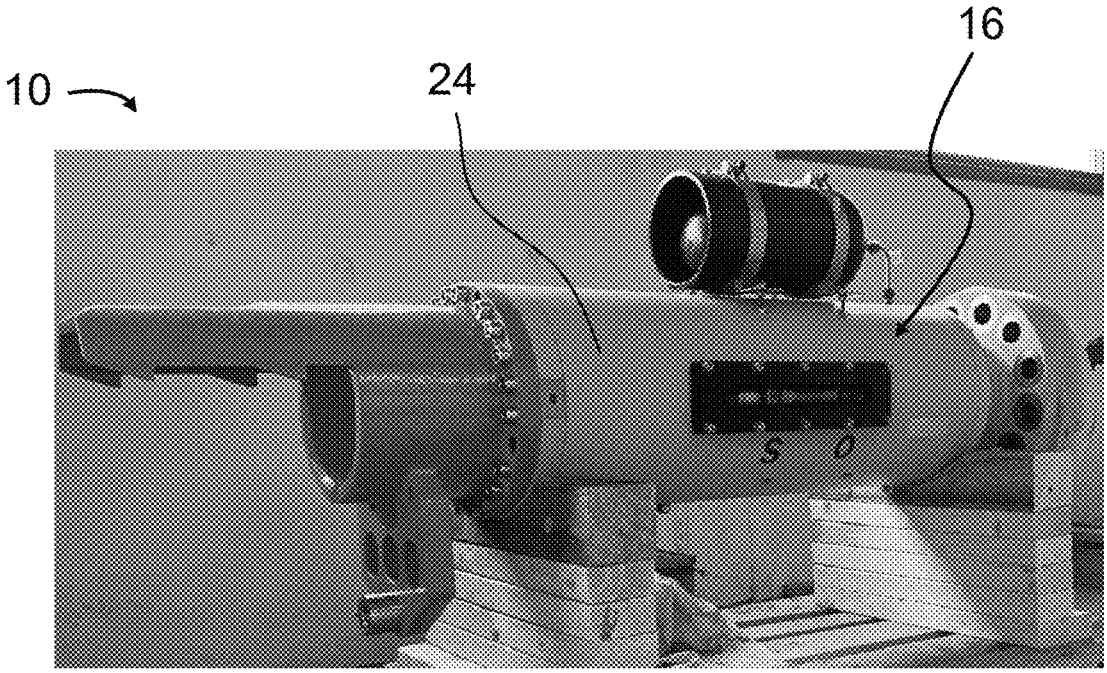
FIG. 4 shows a photographic view of the actuator of FIG. 1.
Figure 5:
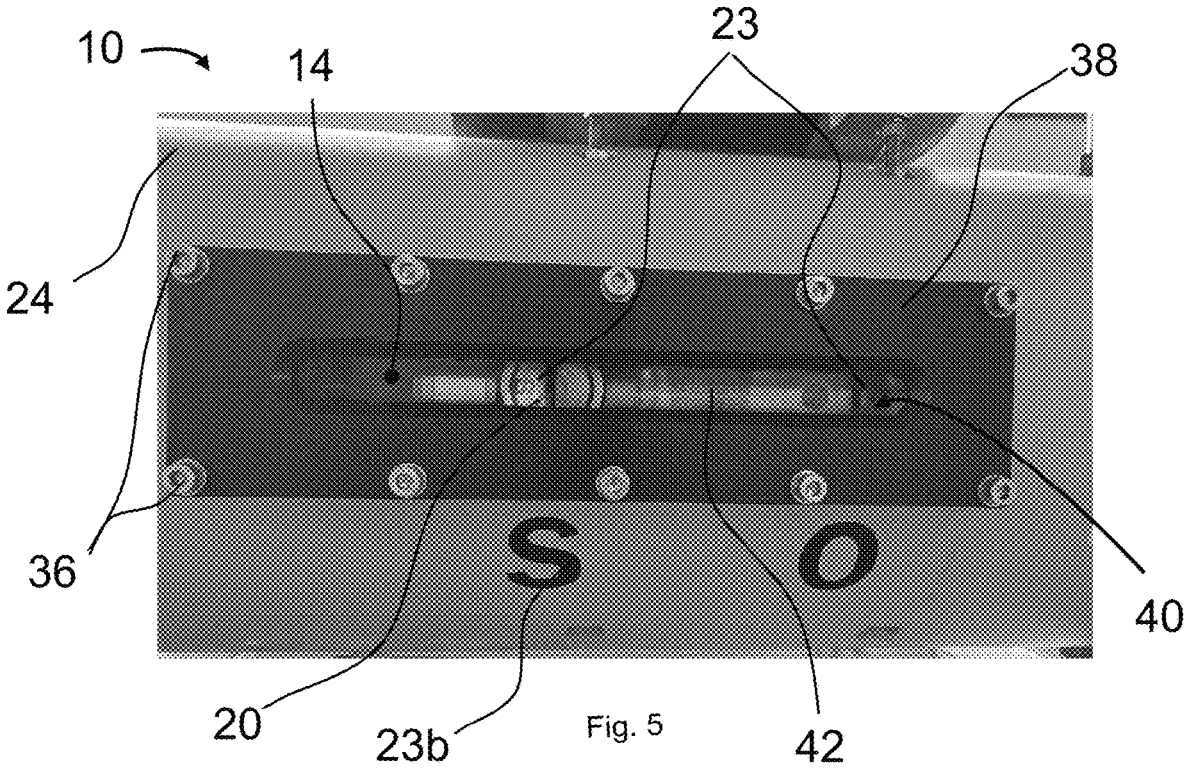
FIG. 5 shows a detail of FIG. 4, showing the actuator in the first configuration.
Figure 6:
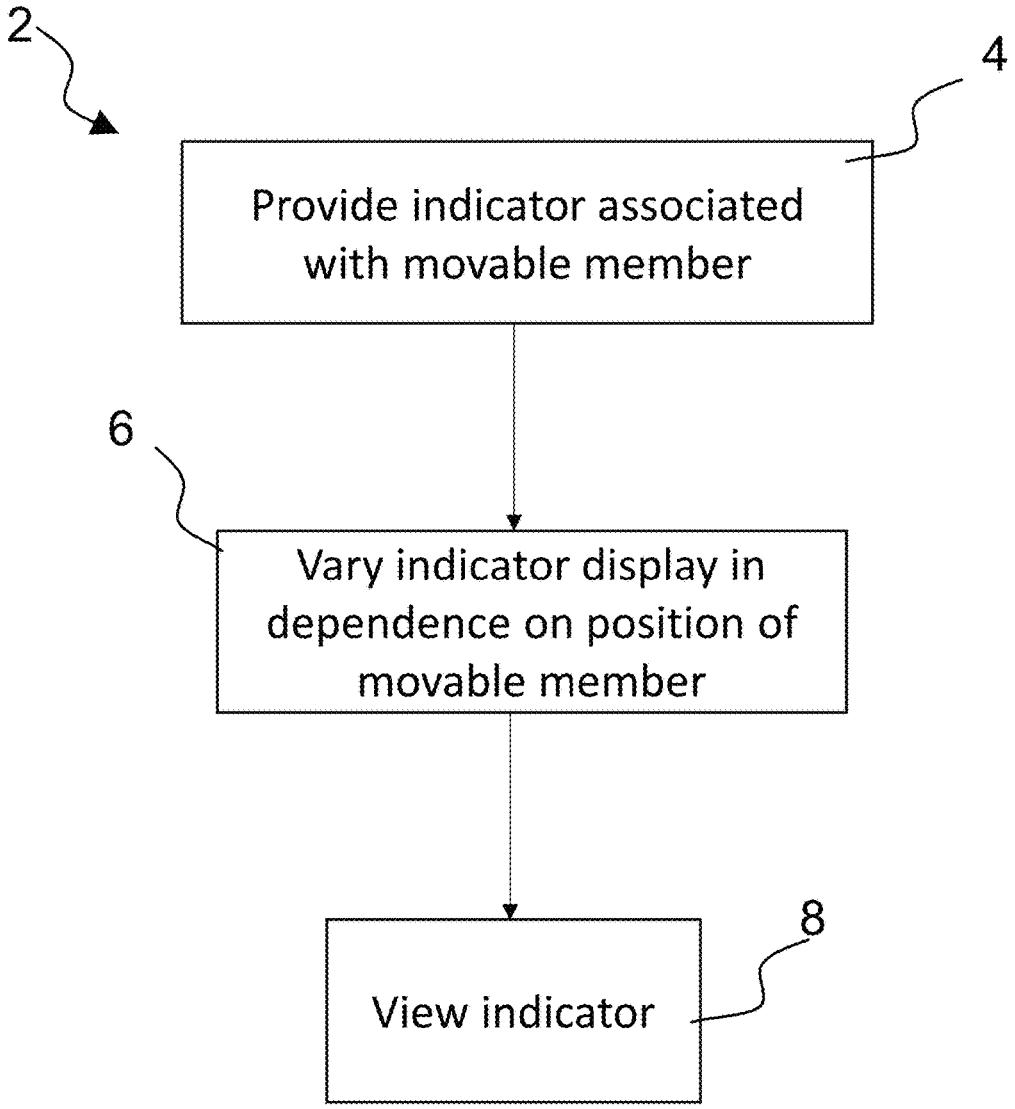
FIG. 6 shows an example of an associated method.

The window 40 here comprises an opening in a sidewall of the housing 24. Here, the housing 24 comprises a cylindrical shape, with the actuation member 14 housed within the housing 24 for movement of the actuation member 14 internally within the housing 24. As also shown in FIGS. 4 and 5, the window 40 comprises a see-through window 40, with the window 40 having a transparent element 42. Particularly when comparing FIGS. 2 and 3, it can be seen that the window 40 here corresponds to all of a stroke of the actuation member 14, with the window 40 extending longitudinally along the side wall of the housing 24, axially extending along at least a same length as a maximum stroke of the actuation member 14.

Referring now to FIG. 4, there is shown a photographic view of the actuator 10 of FIG. 1; with FIG. 5 showing a detail of FIG. 4, with the actuator 10 in the first configuration. Particularly in FIG. 5, it can be seen that the position of the actuation member 14 is directly visible through the window 40. The position indicator 16 comprises a passive indicator, being an unpowered indicator here. In contrast to powered indicators, such as electrical sensors, the position indicator 16 is a passive, unpowered indicator that does not require any additional input or energy compared to normal operation of an otherwise similar actuator 10 but without such an indicator 16 with a window 40.

It will be appreciated that the position indicator 16 here is provided without any dynamic seals. The actuator 10 with the position indicator 16 comprises a same number of dynamic seals as the (same) actuator 10 without the position indicator 16. For example, the actuator 10 has at least the one dynamic seal 32 associated with the valve stem 12, for transferring movement from the actuation member 14 to the external valve via the valve stem 12. Here, there is provided a subsea actuator 10 comprising: a housing 24; an actuation member 14 in the housing 24; a drive connected to the actuation member 14, wherein the drive is configured to move the actuation member 14 between at least two positions; and a position indicator 16 for providing an indication of a position of the actuation member 14, the position indicator 16 being provided without a dynamic seal. The position indicator 16 here comprises a static seal 44, with the window's 40 opening being covered by a window 40 element attached to the housing 24. Here, the window 40 element is mechanically attached to the housing 24 with a static seal 44 between the window 40 element and the housing 24, secured to the housing 24 with a series of bolts 36 and a window mount 38. Although the provision of a window 40 in the actuator 10 housing may appear to represent an undesirable weakening of the structural integrity of the housing 24, the present inventors have maintained the housing's structural integrity with a robust construction.

The window 40 comprises a longitudinal opening in the form of a slot, running longitudinally along the housing 24, in a same direction as a direction of movement of the actuation member 14 within the housing 24. In this example, the opening of the window 40 defines a guide channel for guiding the movement of the actuation member 14 therein. Here, the guide channel comprises an anti-rotation guide channel, with the actuation member 14 connected to an anti-rotation guide member 50. The anti-rotation member 50 is configured to prevent rotation of the actuation member 14, assisting in converting a torque applied to the actuator 10 to a linear movement of the actuation member 14. A movable marker 52 is provided on the guide member 50 here, the guide member 50 being coupled to the actuation member 14. Accordingly, the anti-rotation member 50 is axially movable within the guide channel to guide the axial movement of the actuation member 14; and the movable marker 52 is visible through the window 40 to provide an indication of the axial position of the actuation member 14.

Fixed indicia 23, 23*b* are provided at the display, on the window element 42 and also adjacent the window 40.

In addition to indicating the position of the actuation member 14, the provision of the window 40 can enable various functions. For example, as shown here, there is provided a subsea actuator 10 comprising: a housing 24; an actuation member 14; a drive connected to the actuation member 14, wherein the drive is configured to move the actuation member 14 between at least two positions; and wherein the housing comprises a window 40 in the housing 24, the window 40 providing, in use, viewability into an interior of the housing 24. Such viewability can be useful in detecting ingress of contaminants such as water.

FIG. 5 shows an example of an associated method 2 of indicating a position of the subsea actuation member 14. The method 2 comprises a first step 4 of providing the indicator 10 associated with the movable member 14. A subsequent step 6 entails varying the indicator display in dependence on the position of the movable member 14. It will be appreciated that a step 8 of viewing the indicator 10 can be performed directly by a user (e.g. a diver, inspector, installer, etc.) or via a camera (e.g. on a ROV).

In at least some examples, the method 2 comprises providing the housing 24 of the subsea actuator 10 with the window 40; and connecting the actuation member 14 within the housing to a drive, such that the actuation member 14 is movable between at least two positions. The method 2 comprises providing the indication of the position of the actuation member 14 via the window 40 in the housing.

Accordingly, as also illustrated in the additional FIGS. 1-5 and 7-19, there is provided a method of indicating a position of a subsea actuation member 14, the method comprising:

i. providing a housing 24 of the subsea actuator 10 with a window 40;
ii. connecting an actuation member 14 within the housing 24 to a drive, such that the actuation member 14 is movable between at least two positions; and a
iii. providing an indication of a position of the actuation member 14 via the window 40 in the housing 24.

As shown in FIGS. 1 through 5, the method 2 comprises viewing the actuation member 14 through the window 40 when the actuation member 14 is in both of the two positions and all intermediate positions therebetween. The method 2 here comprises indicating the position of the actuation member 14 in an event of a power failure to the actuator 10, with the position indicator 16 here being provided as a passive, unpowered indicator.

Accordingly, the method 2 here comprises visually inspecting the actuator 10 to monitor or check the position of the actuation member 14.

Figure 7:
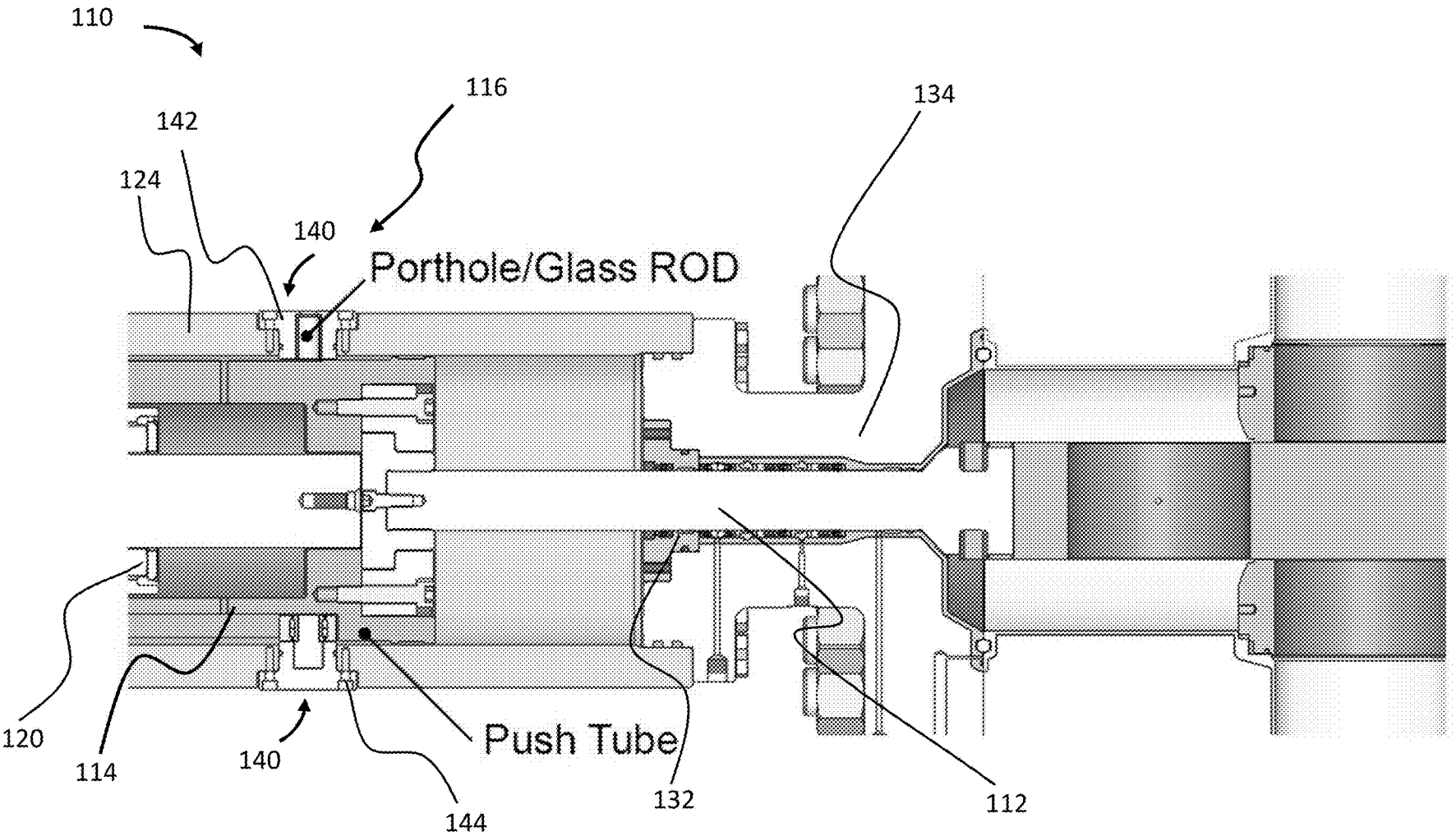
FIG. 7 shows a schematic cross-sectional view of another actuator according to the present disclosure.
Figure 8:
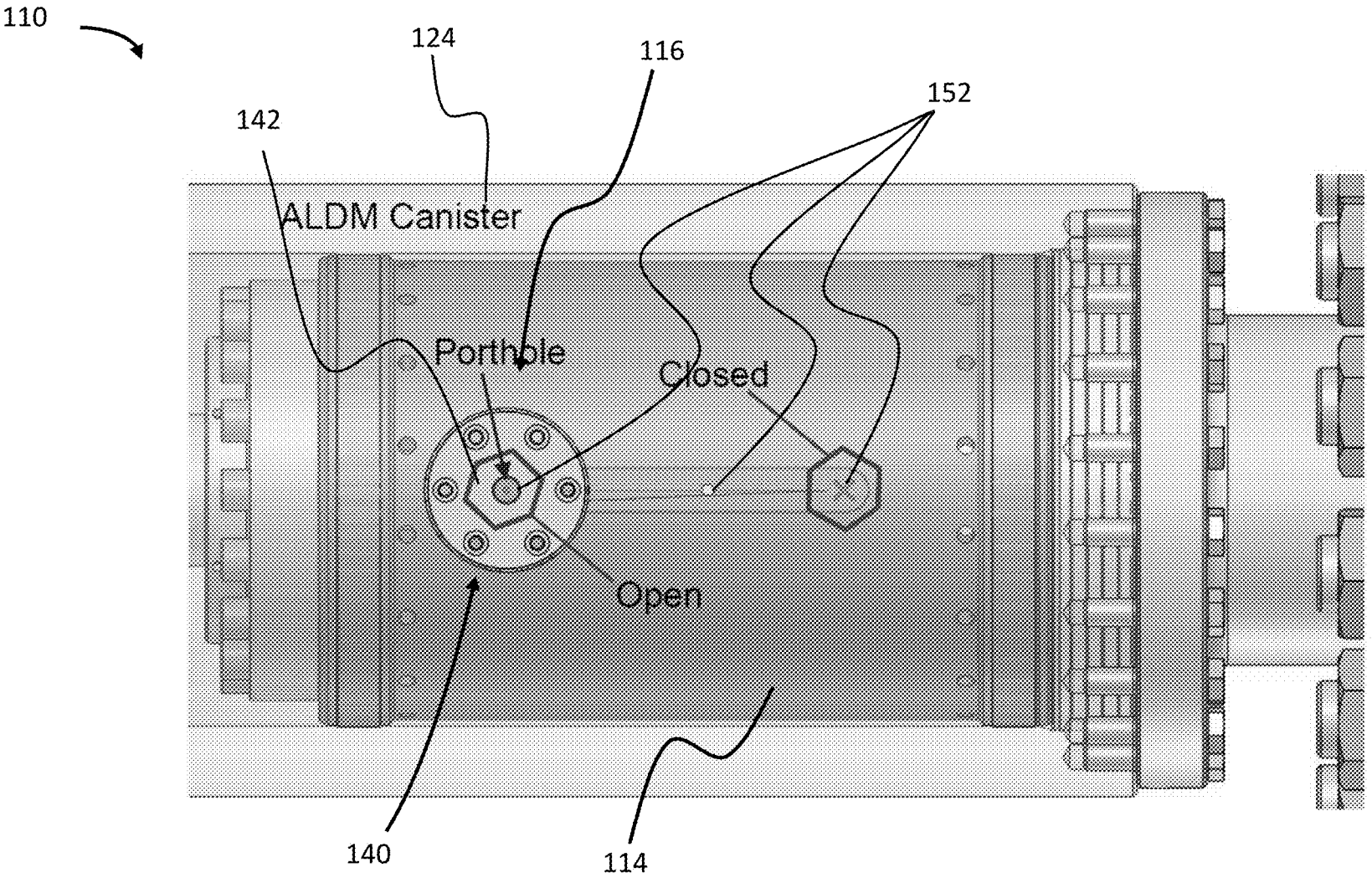
FIG. 8 shows a schematic view of the actuator of FIG. 7.

Referring now to FIG. 7, there is shown a schematic cross-sectional view of another actuator 110 according to the present disclosure, with FIG. 8 showing another schematic view. The actuator shown in FIGS. 7 and 8 is generally similar to that shown in FIGS. 1 to 5, with like features denoted by like reference numerals, incremented by 100. Accordingly, the actuator 110 comprises a position indicator 116 and a movable member 114. For brevity, not all descriptions of all features common to both embodiments are repeated.

As shown in FIGS. 7 and 8, the window 140 comprises a circular porthole. Accordingly, the window 140 here corresponds to only a portion of the stroke. Here, a pair of diametrically opposed windows 140 are provided, increasing accessibility for viewing. To improve indication of a relative position of the movable member 114, the movable member 114 is provided with a movable marker 152 in the form here of a scale, gauge or other indicia. As visible in the partially-transparent (purely for illustration purposes) housing 124 of FIG. 8, here there is a push tube associated with the movable member 114 that has symbols milled into to act as the movable marker 152 to indicate the movable member's 114 position (and the corresponding valve position). Accordingly, a relative position of the actuation member 114 is indicated by the part of the scale, gauge or other indicia that corresponds to (e.g. is adjacent) the window 140 for that position of the actuation member 114 in its stroke (e.g. where an "o" symbol is visible through the porthole window 140, the actuator member 114 is in an open position; where an "x" symbol is visible through the porthole window 140, the actuator member 114 is in a shut or closed position; with options for intermediate symbols—or a sliding triangular scale as shown in FIG. 8).

Figure 9:
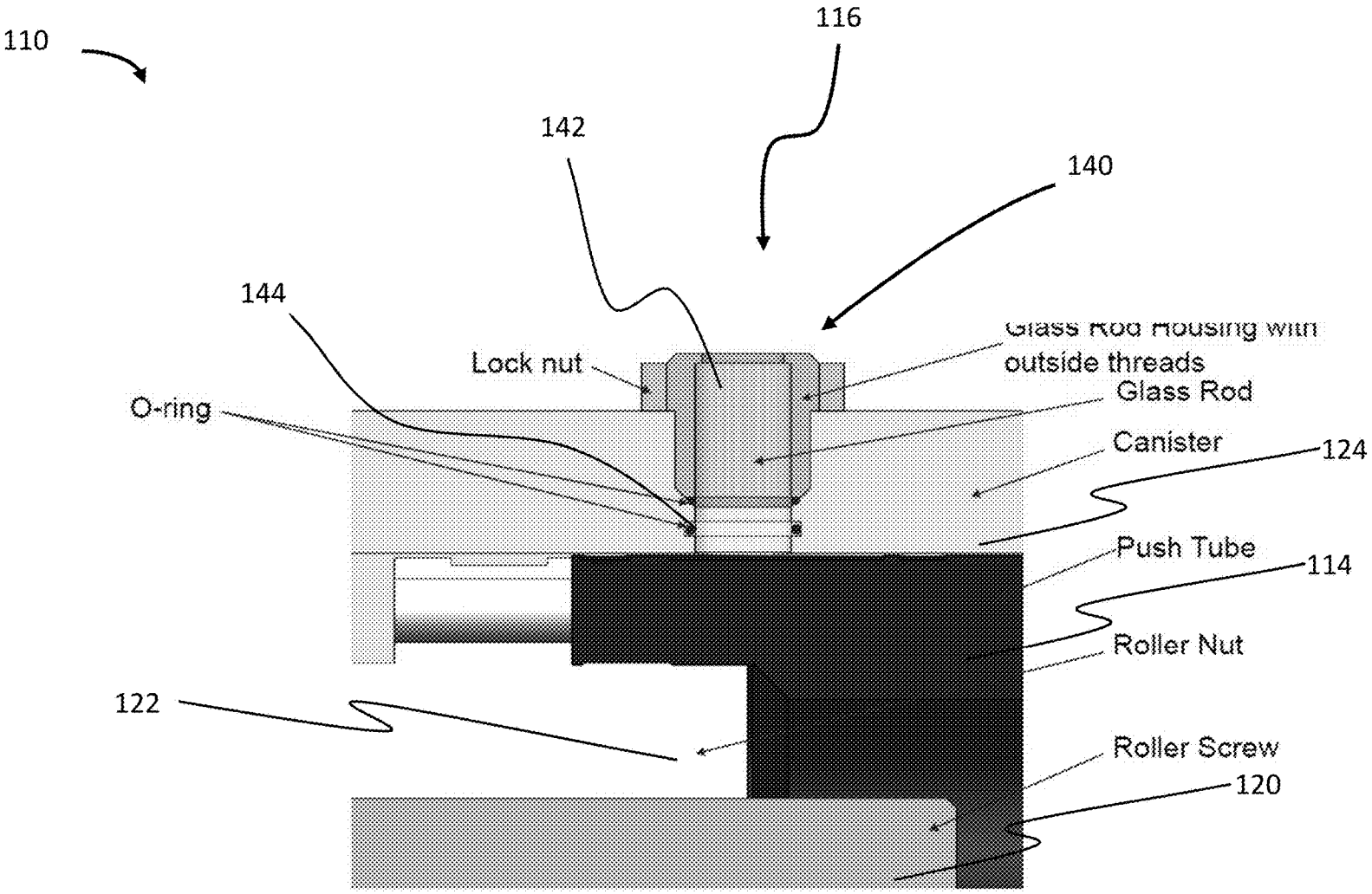
FIG. 9 shows a further schematic cross-sectional view of the actuator of FIG. 7.

The window 140 here comprises a see-through window 140, with a transparent window clement 142, such as glass or transparent plastic (e.g. a polyamide). FIG. 9 shows a further schematic cross-sectional view of the actuator of FIG. 7, with the robust construction including the static seal 144 clearly depicted.

Figure 10:
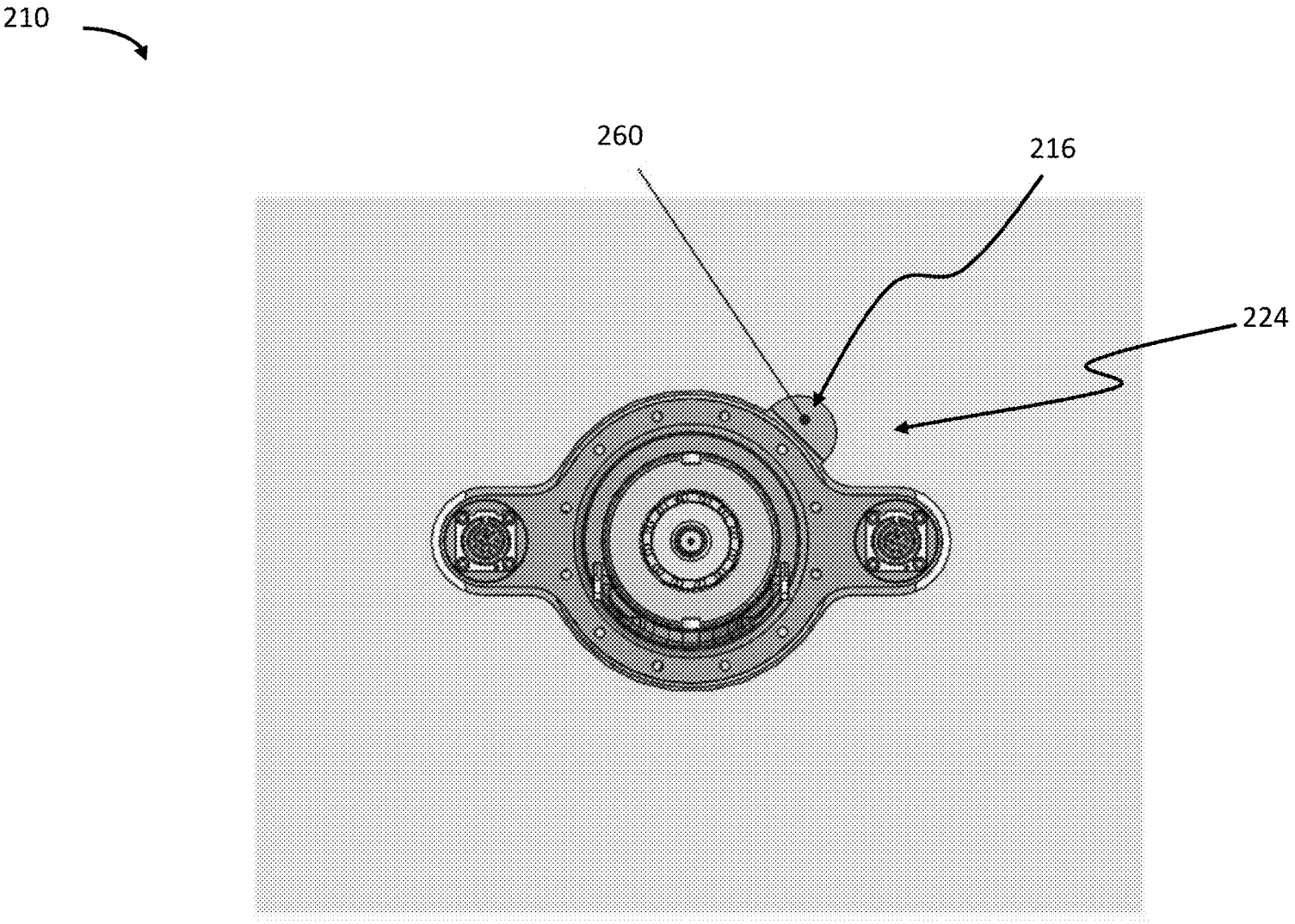
FIG. 10 shows a schematic end view of another actuator according to the present disclosure.
Figure 11:
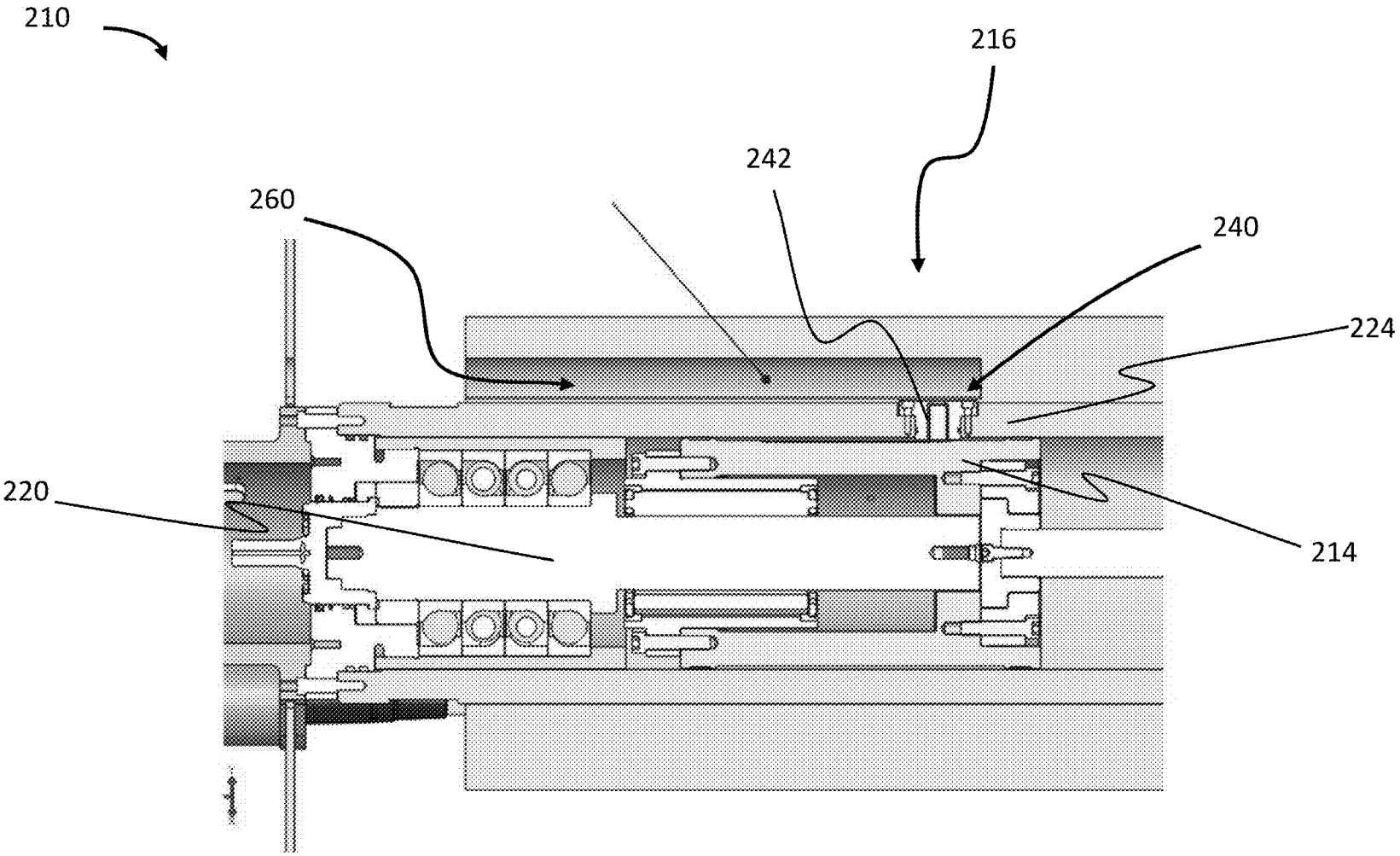
FIG. 11 shows a schematic cross-sectional view of the actuator of FIG. 10.
Figure 12:
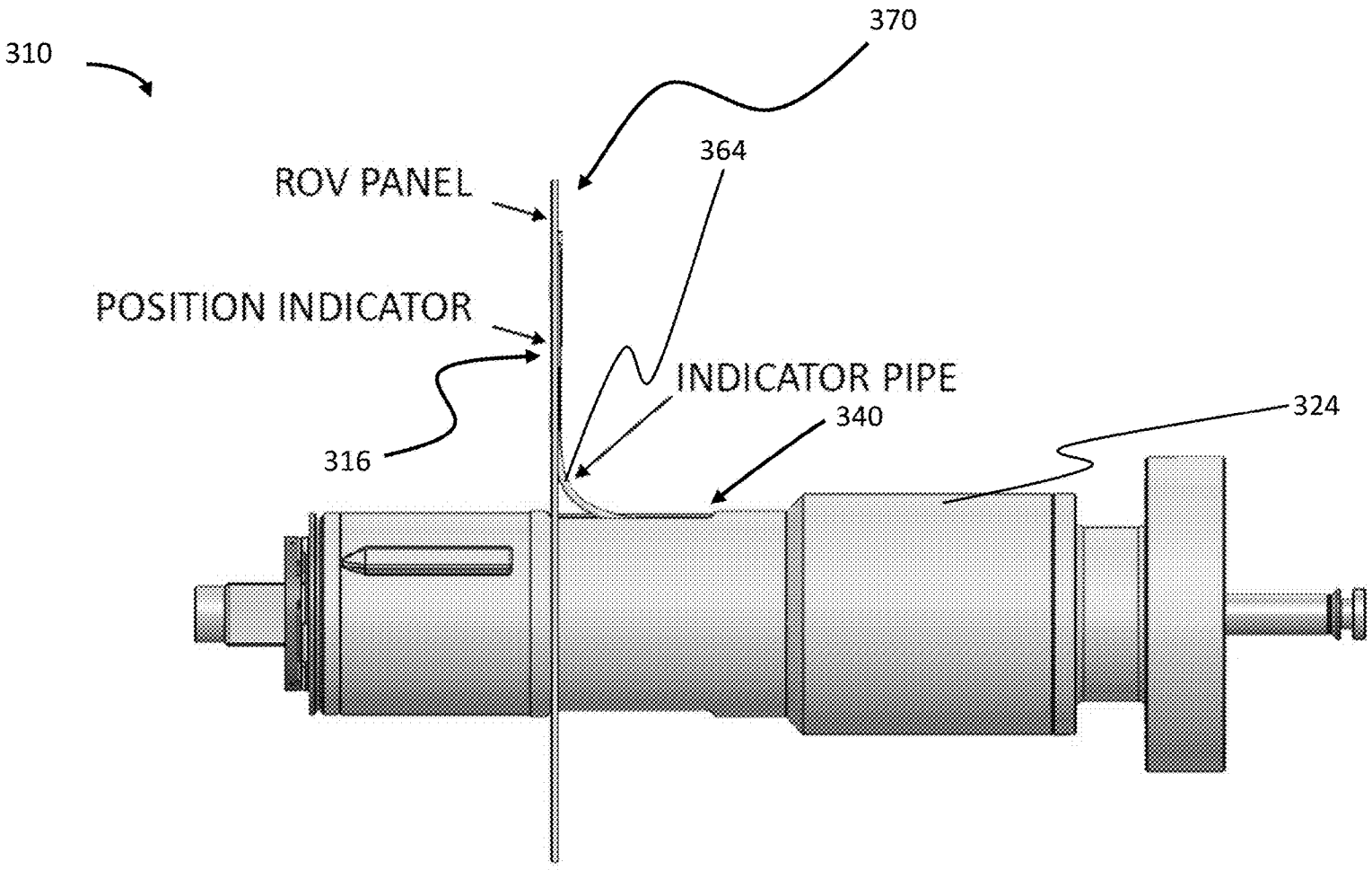
FIG. 12 shows a schematic side view of another actuator according to the present disclosure.
Figure 13:
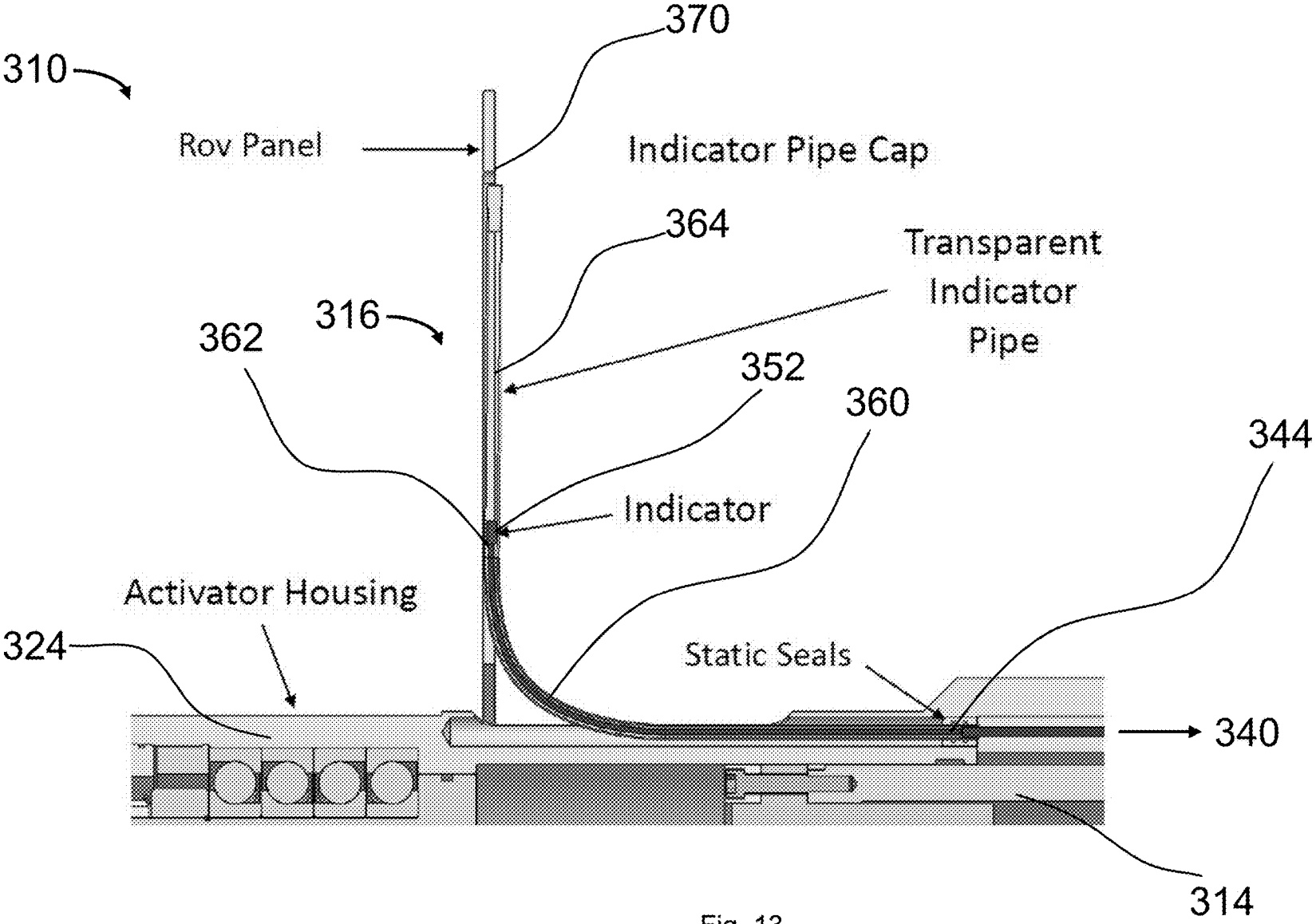
FIG. 13 shows a schematic cross-sectional view of a portion of the actuator of FIG. 12.
Figure 14:
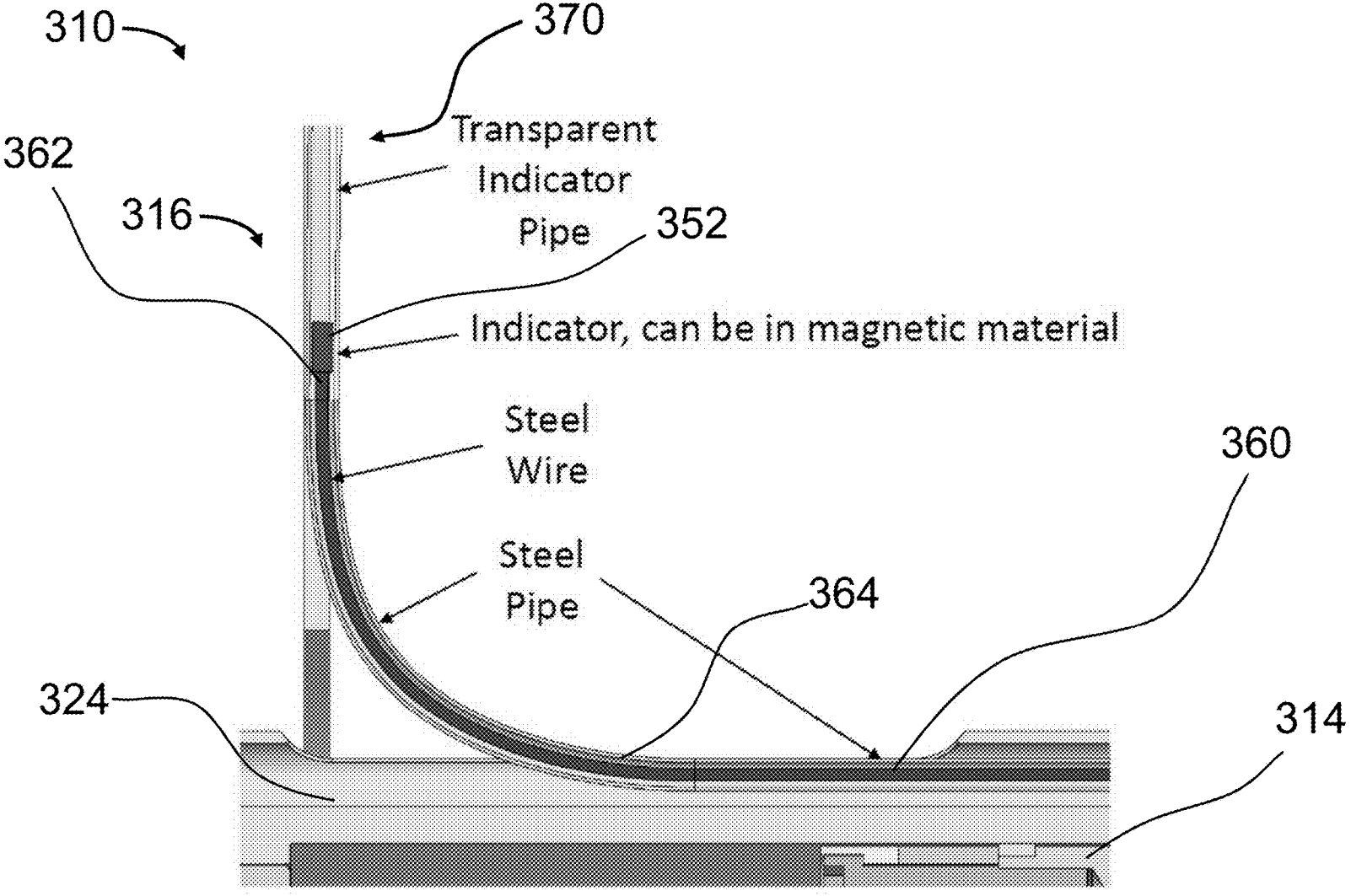
FIG. 14 shows a detail of FIG. 13.

Referring now to FIGS. 10 and 11, there is shown another actuator 210 according to the present disclosure. The actuator 210 shown in FIGS. 10 and 11 is generally similar to that shown in FIGS. 7 to 9, with like features denoted by like reference numerals, incremented by 100. Accordingly, the actuator 210 comprises a position indicator 216 and a movable member 214. For brevity, not all descriptions of all features common to both embodiments are repeated.

Again here the window 240 comprises an opening in a side wall of a cylindrical housing 224. Similar to FIGS. 7 to 9, the window 240 here is a porthole corresponding to only a portion of the stroke of the actuation member 214.

Here, a longitudinal indicator member can be connected to the opening. In this example, an optical member, such as an endoscope (not shown) can be connected to the window 240 using a guidehole 260 to securely position the endoscope and ensure good alignment of the proximal end of the endoscope with the window 240. Accordingly, the position of the actuator member 214 can be viewed through the endoscope. It will be appreciated that in at least some examples the endoscope can be permanently connected to the window 240, with the endoscope providing a permanent display of the position of the actuator member 214 at its distal end, such as for or on a ROV panel, for viewing with a ROV. It will be appreciated that as well as transmitting light from the window 240 to display the position of the actuator member 214, the endoscope can additionally supply light for illuminating through the window 240. The light can be ambient or supplemented with external light (e.g. powered light provided by a ROV or the like).

Referring now to FIGS. 12, 13, 14, 15 and 15*b*, there is shown another actuator 310 according to the present disclosure. The actuator 310 shown in FIGS. 12, 13, 14, 15 and 15*b* is generally similar to that 210 shown in FIGS. 10 and 11, with like features denoted by like reference numerals, incremented by 100. Accordingly, the actuator 310 comprises a position indicator 316 and a movable member 314. For brevity, not all descriptions of all features common to both embodiments are repeated.

Again here the window 340 comprises an opening in a side wall of a cylindrical housing 324. Here, the longitudinal member 360 is a mechanical member, for transmission of movement between the opening and the display end 362. The mechanical member 360 shown is a movable, bendable, flexible wire, housed in a tube 364. The wire 360 is attached to the actuator member 314 within the housing 324, extends through the window 340 in the sidewall of the housing 324, passes through a first portion of tube 364, here made of steel, supporting the tube 364 with wire 360 therein around a 90 degree bend away from the proximal end of the wire 360 that is connected to the axially-movable actuator member 314. It will be appreciated that the mechanical member 360 has a fixed length, in use, such that the movable marker 352 moves directly proportionally along a transparent portion of the tube 364 when the actuator member 314 moves. Accordingly, the position indicator 316 provides a visual indication of status.

Figure 15:
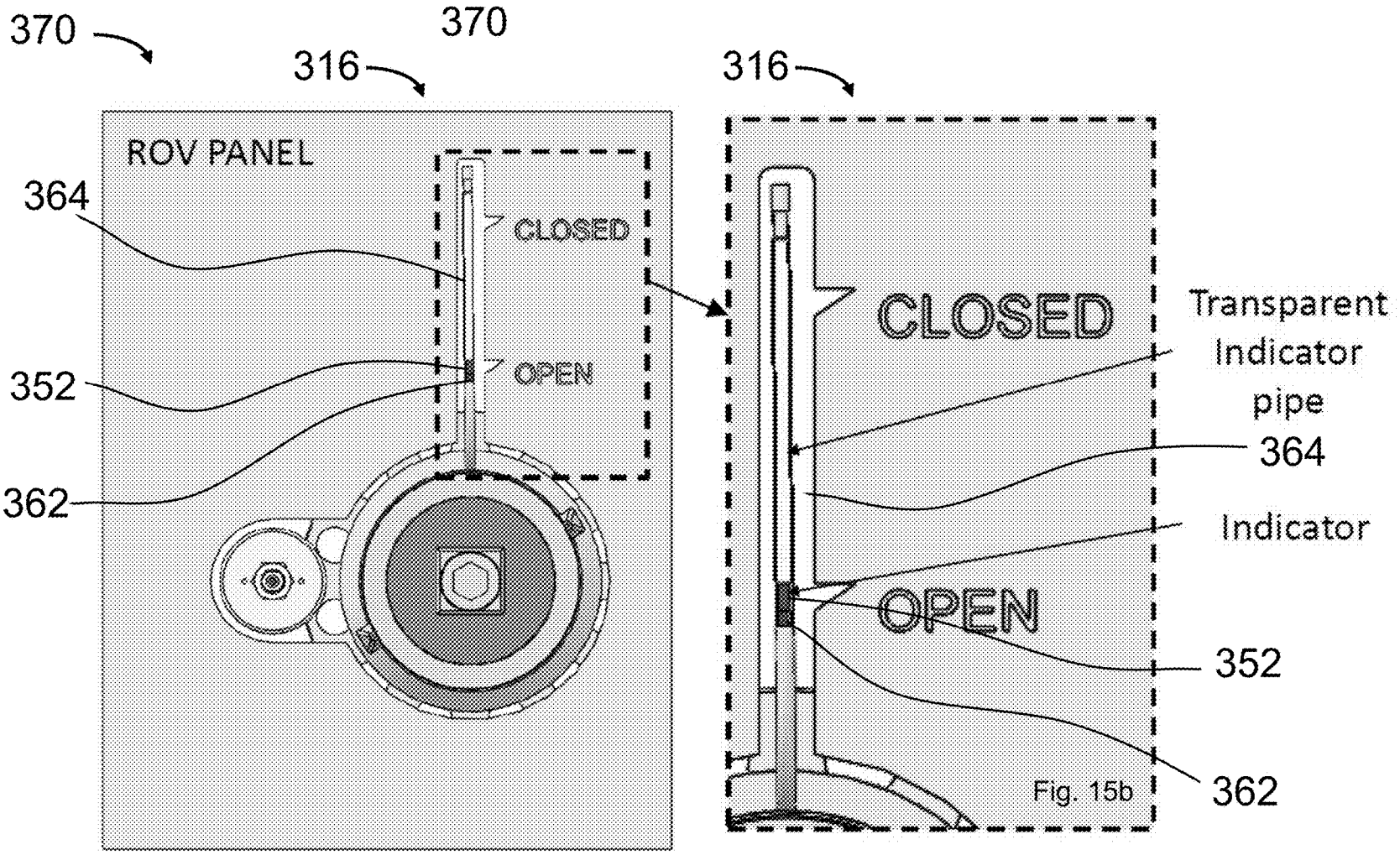
FIG. 15 shows a display panel of the actuator of FIG. 12, with FIG. 15*b* showing a detailed view.

As particularly clear in FIGS. 15 and 15*b*, the position indicator 316 is configured to display the indication of the position of the actuation member 314 on a ROV panel 370. Here, the position indicator 316 extends to the ROV panel 370, with the longitudinal member 360 extending through the opening of the window 340 to the ROV panel 370.

The actuator 310 here comprises an oil-filled, pressure compensated actuator 310. All of the components of the indicator 310 are still located within a fluid system of the actuator 310. Accordingly, all of the moving parts of the indicator 310, particularly the wire 360 with the indicator 352 at its distal end, are located within the oil-filled, pressurised volume associated with the interior of the housing 324. Accordingly, here there are again only static seals 344 associated with the position indicator 316: there are no dynamic seals required for the position indicator 316 (no parts move into/out of the fluid system).

Figure 16:
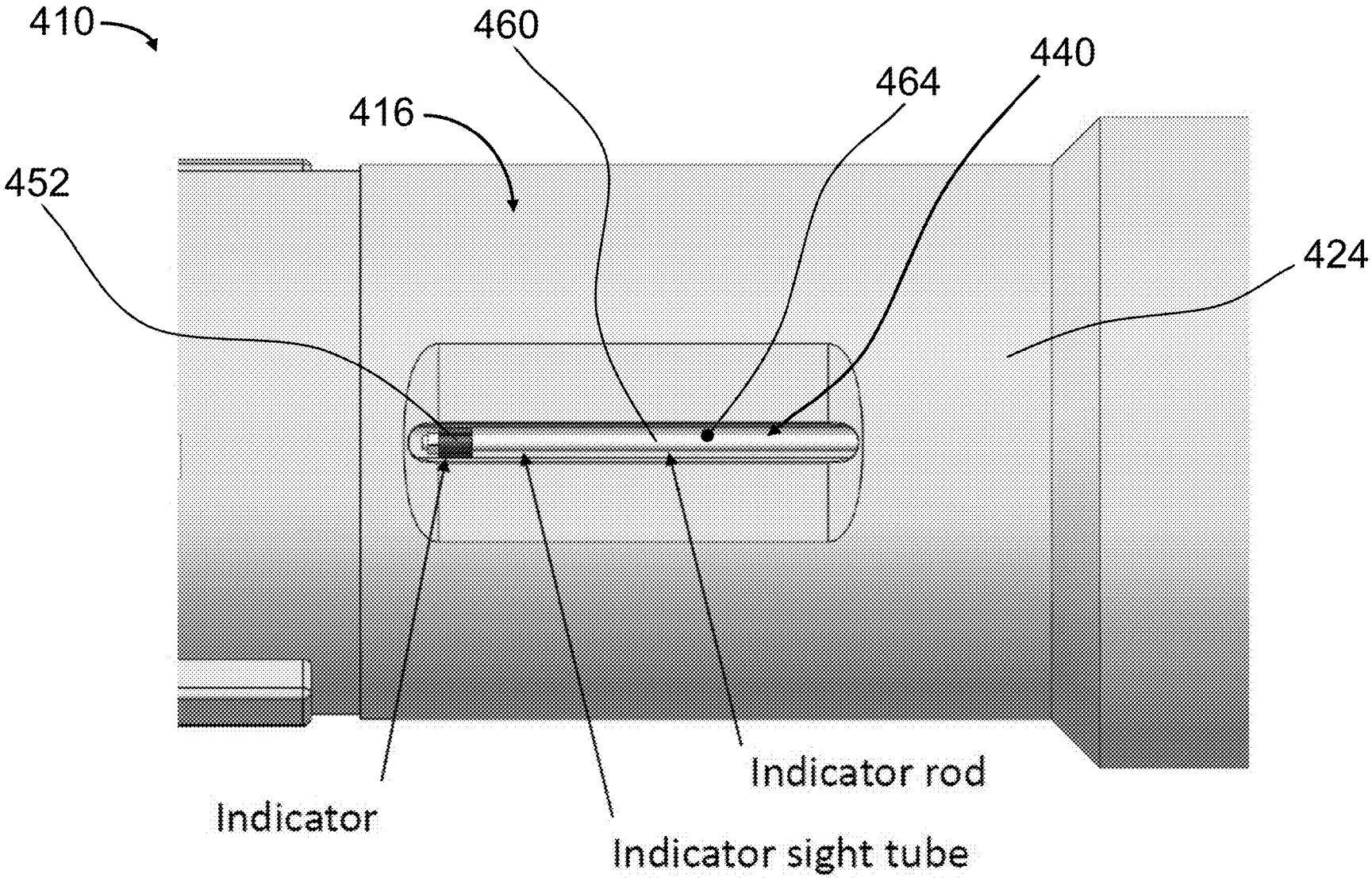
FIG. 16 shows a schematic side view of another actuator according to the present disclosure.
Figure 17:
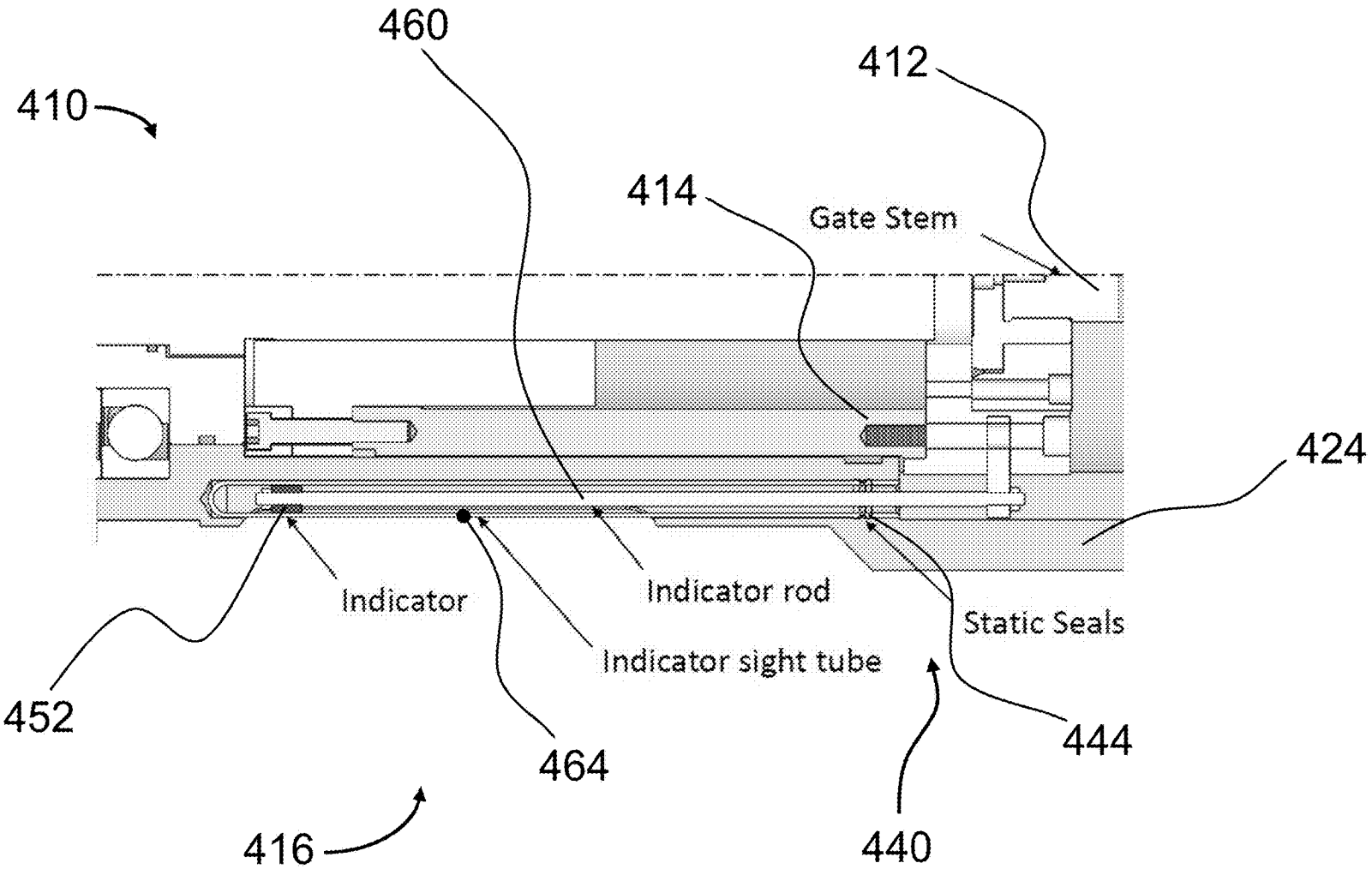
FIG. 17 shows a schematic cross-sectional view of a portion of the actuator of FIG. 16; and s.

Referring now to FIGS. 16 and 17, there is shown another actuator 410 according to the present disclosure. The actuator 410 shown in FIGS. 16 and 17 is generally similar to that 310 shown in FIGS. 12, 13, 14, 15 and 15*b*, with like features denoted by like reference numerals, incremented by 100. Accordingly, the actuator 410 comprises a position indicator 416 and a movable member 414. For brevity, not all descriptions of all features common to both embodiments are repeated.

Again here the window 440 comprises an opening in a side wall of a cylindrical housing 424; and the longitudinal member 460 is also a mechanical member, for transmission of movement. However, here the longitudinal member 460 is a rigid member that extends parallel to the axial movement of the actuator member 414, in the sidewall of the housing 424, housed in a transparent tube 464. Again, the movable marker 452 moves directly proportionally along a transparent portion of the tube 464 when the actuator member 414 moves. Accordingly, the position indicator 416 provides a visual indication of status.

Again, here there are only static seals 444 associated with the position indicator 416: there are no dynamic seals required for the position indicator 416 (no parts move into/out of the fluid system).

As shown here, the subsea actuator 410 comprises an oil-filled, pressure compensated electrically-driven actuator 410 where the housing 424 comprises a pressurised container with an oil-filled compensated volume. The oil here comprises a synthetic gear oil, such as based on polyglycol.

It will be appreciated that the indicator 416 can provide an indication of a presence of a fault within the housing 424. Via the opening of the window 440, an indication of a presence of a possible future fault can be provided, such as a presence of ingress of a contaminant or other undesirable material, such as water, in the housing 424. Accordingly, the window 440 can help provide an early indication, of a potential failure or fault, such as could be caused by an undesirable penetration of water into the housing 424 (e.g. due to a failed seal or other pressure integrity issue). Accordingly, the window 440 can be used to provide an indication of the position of the actuation member 414 and also of a presence of a contaminant or other undesirable material. With suitable density of the oil filling the housing 424, water penetrating into the housing 424 can travel (by buoyancy) via the window's opening to become readily visible with the indicator 416. The presence of a contaminant or other undesirable material can be a precursor to a possible future failure of the actuator 410. For example, where water has penetrated into the actuator 410, then the movement of the actuation member 414 can become inhibited (e.g. due to displacement of (lubricating or insulating) oil, development of rust, marine growth, etc.). Accordingly, (early) detection of the presence of water via the window 440 can help pre-empt an actual failure developing.

Again, all of the components of the indicator 416 are located within a fluid system of the actuator 410, with all of the moving parts of the indicator 416 being located within the oil-filled, pressurised volume associated with the interior of the housing 424.

Figure 18:
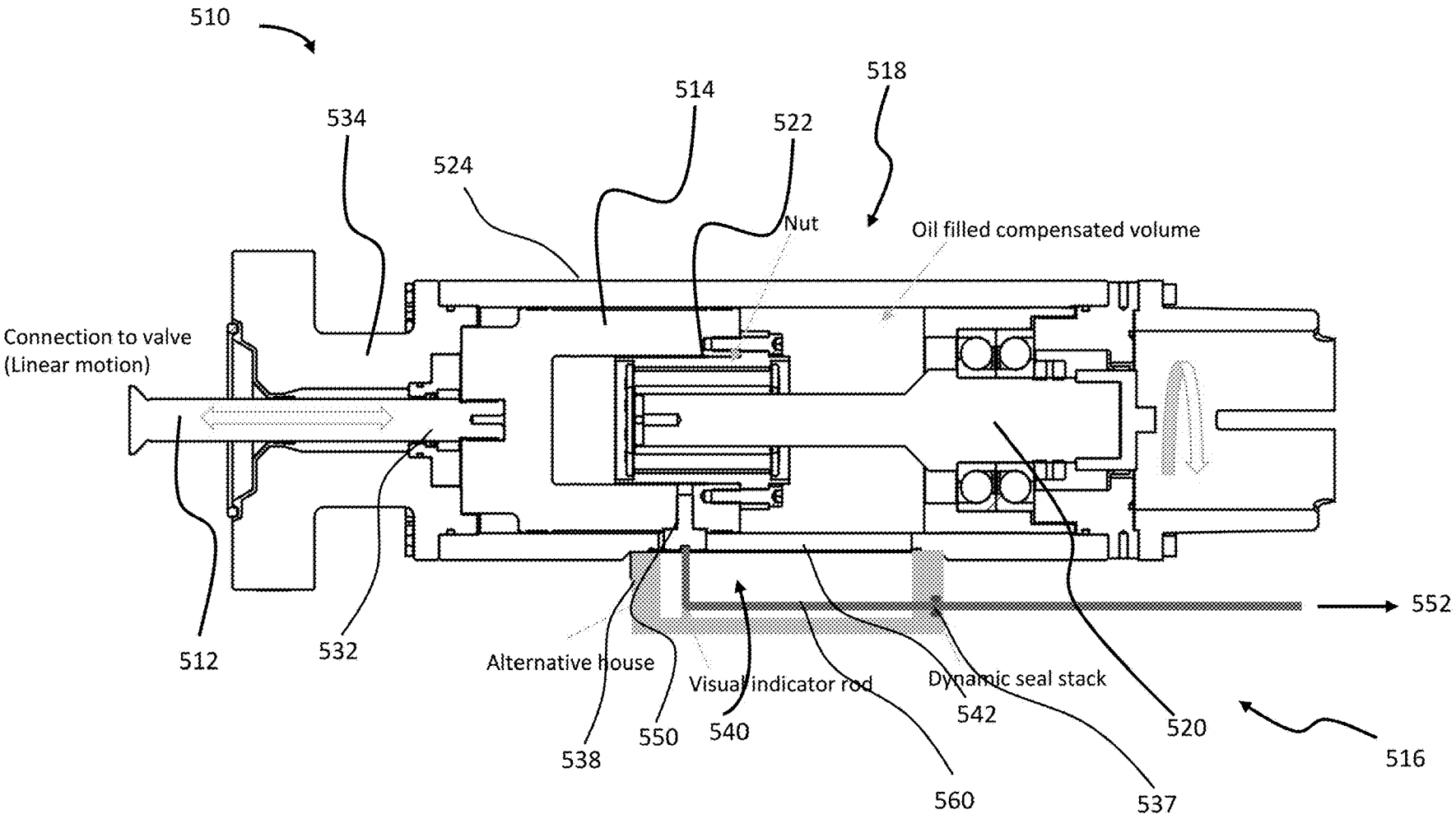
FIG. 18 shows a schematic side view of another actuator according to the present disclosure.

Referring now to FIG. 18, there is shown another actuator 510 according to the present disclosure. The actuator 510 shown in FIG. 18 is generally similar to that 410 shown in FIGS. 16 and 17, with like features denoted by like reference numerals, incremented by 100. Accordingly, the actuator 510 comprises a position indicator 516 and a movable member 514. For brevity, not all descriptions of all features common to both embodiments are repeated.

The actuator 510 shown in FIG. 18 is the only example shown here with a dynamic seal 537 for the position indicator 516. This arrangement allows the longitudinal member 560 to extend through the opening of the window 540, to pass through the dynamic seal 537 and transfer mechanically a position of the actuator member 514 within the housing 524. Accordingly, the longitudinal member 560 can be used to provide position indication more similarly to other indicators associated with dynamic seals in axial end portions of actuators (not shown here). It will be appreciated that multiple embodiments, such as depicted in the various FIGS. 1 to 18 may utilise components common to multiple embodiments. For example, the housing 524 of FIG. 18 may be generally similar to that of another embodiment, such as that 24 of FIG. 1. Accordingly, total inventory of components can be reduced, whilst offering an array of different embodiments.

It will be appreciated that the subsea actuators 10, 110, 210, 310, 410, 510 can be used in subsea oil and gas equipment, such as a part of a subsea well. In other examples, the subsea actuators 10, 110, 210, 310, 410, 510 are used in a subsea energy installation such as for a wind turbine, tidal generator, subsea chemical process, hydrogen or CO2 processing, or the like.

Accordingly, there are provided subsea systems comprising at least one of the subsea actuators 10, 110, 210, 310, 410, 510 and a subsea structure. The subsea structure comprises at least one of: an oil/gas structure; a Xmas tree; a manifold; a subsea control module; a valve/s.

Throughout the description and claims of this specification, the words "comprise" and "contain" and variations of them mean "including but not limited to", and they are not intended to (and do not) exclude other components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

All of the features disclosed in this specification (including any accompanying claims, abstract and drawings), and/or all of the steps of any method or process so disclosed, may be combined in any combination, except combinations where at least some of such features and/or steps are mutually exclusive. The applicant indicates that aspects of the present disclosure may consist of any such individual feature or combination of features. It should be understood that the embodiments described herein are merely exemplary and that various modifications may be made thereto without departing from the scope of the disclosure. For example, it will be appreciated that although generally shown here with single windows, other examples comprise further windows.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed. The claims should not be construed to cover merely the foregoing embodiments, but also any embodiments which fall within the scope of the claims, including with equivalence.

The invention claimed is:

1. A subsea actuator comprising:

a housing having a sidewall disposed about a central axis;

an actuation assembly comprising a rotational portion and an axial portion, wherein the rotational portion is coupled to the axial portion in the housing, and wherein the actuation assembly is configured to convert between a rotational motion of the rotational portion about the central axis and an axial motion of the axial portion along the central axis;

a drive connected to the rotational portion of the actuation assembly, wherein the drive is configured to drive the rotational motion of the rotational portion to cause the axial motion of the axial portion between at least two positions;

a window in the sidewall of the housing, wherein the window axially overlaps an area having the actuation assembly, and wherein an opening of the window defines an anti-rotation guide channel extending in an axial direction along the central axis; and a position indicator coupled to the axial portion, wherein the position indicator is disposed inside the housing in the area having the window, wherein the position indicator is configured to provide, through the window, an indication of a position of the axial portion, wherein the position indicator is configured to move with the axial motion of the axial portion in the axial direction along the anti-rotation guide channel of the window, and wherein the position indicator is configured to interact with the anti-rotation guide channel of the window to block rotation of the axial portion, assisting in a conversion of the rotational motion of the rotational portion into the axial motion of the axial portion.

2. The subsea actuator of claim 1, comprising an anti-rotation guide member having the position indicator configured to interact with the anti-rotation guide channel.

3. The subsea actuator of claim 2, wherein the window comprises a longitudinal window, extending in the axial direction along the central axis in the sidewall of the housing, in a same direction as the axial motion of the axial portion of the actuation assembly within the housing, and the actuation assembly comprises a screw assembly having the rotational portion coupled to the axial portion via a threaded interface.

4. The subsea actuator of claim 1, wherein the position indicator is viewable through the window in both of the two positions and all intermediate positions therebetween of the actuation assembly.

5. The subsea actuator of claim 1, wherein the window comprises a window element made of a translucent or transparent material, the position indicator is a visual indicator viewable through the window element, the position indicator comprises a passive, unpowered indicator, the position indicator is provided without a dynamic seal, and the window element is sealed to the sidewall of the housing via a static seal.

6. The subsea actuator of claim 1, wherein the rotational portion comprises a screw and the axial portion comprises a nut.

7. The subsea actuator of claim 6, wherein the actuation assembly comprises a roller screw assembly, the screw comprises a roller screw, and the nut comprises a roller nut.

8. The subsea actuator of claim 1, wherein the position indicator comprises a movable marker configured to move in the axial direction along a path of travel viewable through the window, wherein at least one fixed indicia, scale or gauge is disposed on the window, the housing, or both, wherein the indicia, scale or gauge comprises a plurality of fixed markings corresponding to different positions of the movable marker in the axial direction along the path of travel.

9. The subsea actuator of claim 1, wherein the position indicator comprises a longitudinal indicator member extending from the opening to a display end, and the longitudinal indicator member comprises a curved portion over at least a portion of a length of the longitudinal indicator member.

10. The subsea actuator of claim 9, wherein the longitudinal indicator member is an optical member configured to transmit light between the opening and the display end.

11. The subsea actuator of claim 9, wherein the longitudinal indicator member comprises a bendable mechanical member configured to move between the opening and the display end, and the bendable mechanical member is configured to bend while moving lengthwise along the length through a tube.

12. The subsea actuator of claim 1, wherein the window is configured to provide an indication of a housing integrity failure comprising at least a presence of water ingress into a lubricant within a housing interior of the housing.

13. The subsea actuator of claim 1, wherein the position indicator is configured to move in the axial direction along a path of travel corresponding to the axial motion of the axial portion of the actuation assembly between the at least two positions, the window is a port window disposed at a discrete position along the path of travel enabling only a partial view of the position indicator, and the position indicator includes visual indicia that are progressively viewable through the port window as the position indicator moves in the axial direction along the path of travel.

14. A method of indicating a position of a subsea actuator, the method comprising:

providing a window in a sidewall of a housing of the subsea actuator, wherein the sidewall is disposed about a central axis, and wherein an opening of the window defines an anti-rotation guide channel extending in an axial direction along the central axis;

connecting an actuation assembly within the housing to a drive, wherein the actuation assembly comprises a rotational portion and an axial portion, wherein the rotational portion is coupled to the axial portion in the housing, wherein the actuation assembly is configured to convert between a rotational motion of the rotational portion about the central axis and an axial motion of the axial portion along the central axis, and wherein the actuation assembly is movable between at least two positions; and providing an indication of a position of the axial portion via a position indicator coupled to the axial portion and viewable through the window, wherein the window axially overlaps an area having the actuation assembly in the housing, wherein the position indicator is configured to move with the axial motion of the axial portion in the axial direction along the anti-rotation guide channel of the window, and wherein the position indicator is configured to interact with the anti-rotation guide channel of the window to block rotation of the axial portion, assisting in a conversion between the rotational motion of the rotational portion and the axial motion of the axial portion.

15. The method of claim 14, comprising moving the position indicator viewable in the window in the axial direction along the central axis in response to the axial motion of the axial portion of the actuation assembly.

16. The method of claim 15, comprising converting between the rotational motion and the axial motion via a threaded interface between the rotational portion and the axial portion.

17. The method of claim 15, comprising:

converting between the rotational motion and the axial motion via the actuation assembly;

moving the position indicator in the axial direction along the anti-rotation guide channel of the window during the converting; and blocking rotation of the axial portion via an anti-rotation guide member of the position indicator in the anti-rotation guide channel during the converting.

18. The method of claim 14, comprising:

driving the rotational motion of the rotational portion via the drive coupled to a drive end of the subsea actuator; and actuating an equipment at a driven end coupled to the axial portion of the subsea actuator, wherein the window and the position indicator are disposed axially between the drive end and the driven end of the subsea actuator.

19. A system, comprising:

an actuator, comprising:

a housing having a sidewall disposed about a central axis;

an actuation assembly comprising a rotational portion and an axial portion, wherein the rotational portion is coupled to the axial portion in the housing, wherein the actuation assembly is configured to convert between a rotational motion of the rotational portion about the central axis and an axial motion of the axial portion along the central axis, and wherein the actuation assembly comprises a screw assembly having the rotational portion threaded to the axial portion;

a window in the sidewall of the housing, wherein the window axially overlaps an area having the actuation assembly, and wherein the window comprises an anti-rotation guide channel extending in an axial direction along the central axis; and a position indicator coupled to the axial portion, wherein the position indicator is disposed inside the housing in the area having the window, wherein the position indicator is configured to provide, through the window, an indication of a position of the axial portion, wherein the position indicator is configured to move with the axial motion of the axial portion in the axial direction along the anti-rotation guide channel of the window, and wherein an interface of the position indicator in the anti-rotation guide channel blocks rotation of the axial portion, assisting in a conversion between the rotational motion of the rotational portion and the axial motion of the axial portion.

20. The system of claim 19, comprising an anti-rotation guide member having the position indicator configured to interact with the anti-rotation guide channel, wherein the rotational portion and the axial portion are coupled together via a threaded interface, the actuation assembly is disposed axially between a drive end and a driven end of the actuator, the drive end is configured to couple to a drive, and the driven end is configured to couple to a valve.

* * * * *